US008678393B2

(12) United States Patent
Reed et al.

(10) Patent No.: US 8,678,393 B2
(45) Date of Patent: Mar. 25, 2014

(54) QUICK RELEASE ARCHERY TARGET

(76) Inventors: Daniel N. Reed, Westfield Center, OH (US); Chris R. Fletcher, Jr., West Salem, OH (US)

( * ) Notice: Subject to any disclaimer, the term of this patent is extended or adjusted under 35 U.S.C. 154(b) by 334 days.

(21) Appl. No.: 13/005,460

(22) Filed: Jan. 12, 2011

(65) Prior Publication Data

US 2011/0169223 A1 Jul. 14, 2011

Related U.S. Application Data

(60) Provisional application No. 61/294,395, filed on Jan. 12, 2010.

(51) Int. Cl.
*F41J 3/00* (2006.01)

(52) U.S. Cl.
USPC ..... 273/403; 273/408

(58) Field of Classification Search
USPC ..... 273/403, 404, 407, 408
See application file for complete search history.

(56) References Cited

U.S. PATENT DOCUMENTS

| | | | | | |
|---|---|---|---|---|---|
| 3,329,431 | A * | 7/1967 | Roesner | 273/403 |
| 4,813,684 | A * | 3/1989 | Bruno | 273/403 |
| 4,940,244 | A * | 7/1990 | Batts, III | 273/403 |
| 5,465,977 | A * | 11/1995 | Mann | 273/408 |
| 5,865,440 | A * | 2/1999 | Pulkrabek | 273/408 |
| 2003/0222403 | A1 * | 12/2003 | Ingold | 273/408 |
| 2004/0140623 | A1 * | 7/2004 | Pulkrabek | 273/408 |
| 2006/0157938 | A1 * | 7/2006 | Box et al. | 273/403 |
| 2009/0134581 | A1 * | 5/2009 | Box | 273/403 |

* cited by examiner

*Primary Examiner* — Mark Graham
(74) *Attorney, Agent, or Firm* — Zollinger & Burleson Ltd.

(57) ABSTRACT

An archery target includes a clamping assembly having at least two conditions wherein a first condition applies compressing force to a target material and a second condition releases at least a portion of the compressing force from the target material such that arrow removal is easier. The clamping assembly allows the user of the target to readily change the clamping assembly between the two conditions. The clamping assembly may be manual, powered, or a combination of the two. The clamping assembly may include a mechanical lever, a winder, a crank, a hydraulic device, or a pneumatic device. The clamping compressing force may be applied from the top, bottom, or sides of the target material. In some configurations, a strap is disposed around the target material and is tightened and loosened to apply and release the compressing force from the target material.

17 Claims, 24 Drawing Sheets

QUICK RELEASE ARCHERY TARGET

CROSS REFERENCE TO RELATED APPLICATIONS

This application claims the benefit of U.S. Provisional Application Ser. No. 61/294,395 filed Jan. 12, 2010; the disclosure of which is incorporated herein by reference.

BACKGROUND OF THE INVENTION

1. Technical Field

The invention generally relates to archery targets used with bows and crossbows and, more particularly, to compressed-material archery targets used with high-velocity arrows and bolts. Specifically, the present invention relates to a target that may be manipulated to release the compressing force from the target material so that the user may easily remove the arrows from the target material.

2. Background Information

Bow and crossbow hunting of wild game and the sport of archery are popular pastimes in the United States. Sportsmen use archery targets to improve their skills before hunting. Archery targets are also used in target shooting competitions. In the context of this application the term 'arrow' is used to refer to arrows and bolts regardless of whether they are shot from a bow, a compound bow, or a crossbow.

A variety of archery target constructions are known in the art. As arrow and bolt speeds approach 350 feet per second on their way to 400 feet per second, target constructions have been developed to safely capture the arrow or bolt. One such target construction is a compressed material target that includes a plurality of stacked material layers placed under compressing force. The compressing force increases the density of the material layers thus increasing their stopping power. One common material is foam although other compressible materials may be used. When foam layers are used, they may be fabricated from open or closed cell foam sheets that each may have a thickness of between one-sixteenth of an inch (1/16") to one-quarter of an inch (1/4") with a density range of three (3.0) pounds per square inch to seven (7.0) pounds per square inch. The foam layers may be made from polyethylene foam. A plurality of foam layers are stacked together and compressed in a frame or other retaining structure to increase the density of the foam to increase the arrow stopping power of the target.

A drawback with compressed foam targets is the amount of force required to remove an arrow embedded in the foam. When arrows are very hard to pull from a target, the shooter practices less. Younger children may not even be able to remove an arrow from some targets. Removing an embedded arrow from some targets can be difficult and can damage the foam material thus shortening the effective life of the target. Pulling an arrow from a compressed target material can also damage the arrow. A slightly bent or deformed arrow is dangerous. Those who use compressed foam targets desire a target construction that allows the arrows to be easily removed from the foam material.

SUMMARY OF THE INVENTION

The invention provides an archery target that includes a clamping assembly having at least two conditions wherein a first condition applies a compressing force to a target material and a second condition releases at least a portion of the compressing force from the target material such that arrow removal is easier. The user of the target may readily change the clamping assembly between the two conditions.

The clamping assembly may be a mechanical, hydraulic, or pneumatic device. The clamping assembly may be manual, powered, or a combination of the two. The compressing force may be applied from the top, bottom, or sides of the target material. In one configuration, the invention provides a latch that holds the clamping assembly in the first condition until the user releases the latch and moves the clamping device to the second condition. The latch may be designed to be released with the user's hand, the user's foot, or in response to a release signal.

The invention also provides an archery target having a clamping configuration that allows different portions of the target material to be compressed to different degrees. This allows the same side of the target to be used with different arrow speeds with the higher speed arrows being stopped by the material that is more highly-compressed while slower speed arrows are stopped by the less-compressed material disposed in front of the highly-compressed material.

The invention also provides a target having removable and replaceable target material sections so that the sections may be replaced after being worn. The target also may be configured with different material densities for different uses on different sides of the target.

The invention also provides a method for using an archery target wherein the method includes the steps of releasing at least some of the compressing force from the target material before the arrows are removed from the target material and reapplying the compressing force to the target material after the arrows are removed.

The invention provides one configuration of the target wherein a mechanical lever assembly is used to apply the compressing force to the target material.

The invention provides one configuration of the target wherein at least one strap encircles the target material. The strap is placed is tension in order to apply compressing force to the target material. A plurality of straps may be used to apply the compressing force. The straps may be placed into tension with a lever, a crank, or a winder. These may be operated manually or powered with cylinders or motors.

The invention also provides a target material layer having opposed indentations at its edges.

The invention provides one configuration of the target wherein the compressing force is applied to the target material with a hydraulic or pneumatic cylinder or a motor that moves the clamping assembly.

These configurations may be used alone or in combination.

BRIEF DESCRIPTION OF THE DRAWINGS

Similar numbers refer to similar parts throughout the specification.

DETAILED DESCRIPTION OF THE INVENTION

Figure 1:
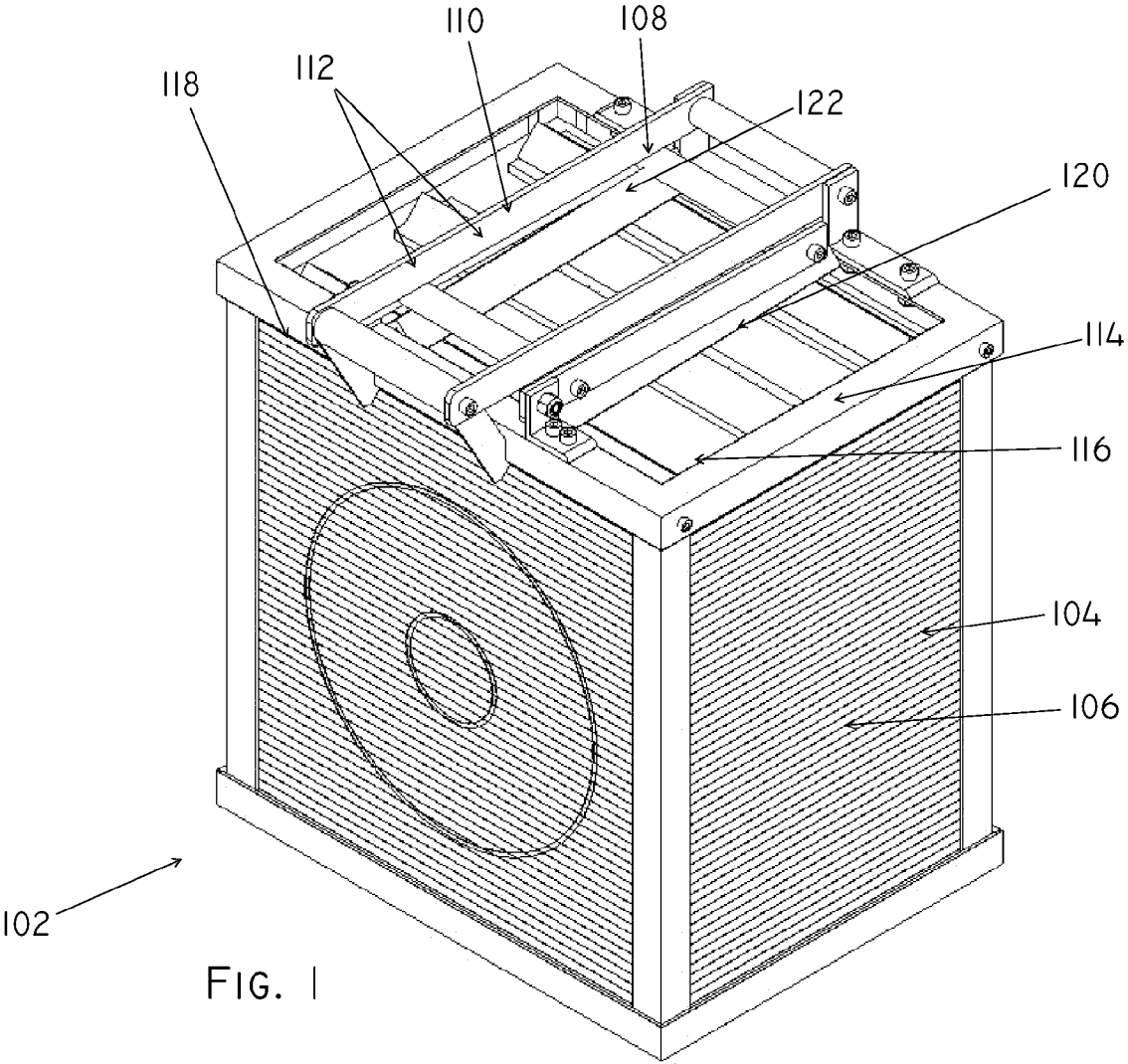
FIG. 1 is a perspective view of a first configuration for the target with its clamping assembly in a first condition applying compressing force to the target material.

Different configurations of exemplary targets are indicated generally by the numerals 102 and 202 in the accompanying drawings. Targets 102 and 202 may be range targets (such as a box or a circle—both portable and fixed), a realistically-sized and shaped three dimensional target (such as an animal torso), or a portion of either of these target types.

A first configuration of target 102 is depicted in FIGS. 1-11 and generally includes a frame 104, a target material 106, and a clamping assembly 108. Clamping assembly 108 may be placed into first and second conditions with respect to target material 106. The first condition applies compressing force to target material 106 so that target 102 may be used to stop arrows from a bow or crossbow. As described in the Background Information, there are problems with removing arrows from compressed target material. As such, the second condition of clamping assembly 108 releases at least a portion of the compressing force from target material 106 so that the arrows may be readily removed from target material 106.

Frame 104 may be a rigid box-shaped frame made from a rigid building material such as steel, stainless steel, aluminum, plastic, wood, or paper-based materials. In the exemplary configuration, frame 104 is in the form of a hollow box with five open sides and a solid tray-like bottom that receives target material 106. Frame 104 may be provided is separate parts that can be replaced if one is damaged during use. For example, the front of frame 104 may be provided in separate parts that bolt together.

Target material 106 may be a solid block of material such as a compressible foam material or a plurality of individual layers such as a plurality of stacked foam layers. A resilient closed or open cell foam may be used. Known target materials such as those described above in the Background Information may be used. Target material 106 defines a plurality of sides which, in the exemplary configuration, are the top, bottom, and four sides of the block of the target material 206. The foam may be any of those used for archery targets and equivalents. Other materials such as compressible paper-based target materials and fabrics may be used as target material 106. Other resilient compressible materials may be used. When the material is disposed in layers, the layers may be uniform in density and thickness. The layers may be disposed horizontally or vertically (see FIGS. 21-23). The layers also may be varied in density and/or thickness. For example, target 102 may be configured for higher speed arrows through the front opening of frame 104 and slower speed arrows through the rear opening of frame 104 by changing the density of the target material positioned near the front and rear openings. For example, when the layers of target material 106 are disposed vertically, higher density material may be positioned next to the high speed side of the target while less dense material is positioned on the lower speed side of the target. Target material 106 may be split down the middle portion of target 102 with high speed target material disposed on one side and low speed target material disposed on the other side of target 102. Each layer of material 106 also may be split.

Target 102 allows different portions of target material to be compressed to different degrees. This allows the rear portion target material 106 to be more highly compressed than the front portion. In such a configuration, a low speed arrow may be stopped by the front portion while a high speed arrow may be stopped by the rear portion. Such a target configuration is useful when an adult and a child are shooting at a common target with different bows. In the exemplary configuration, clamping assembly 108 includes a press plate 110 disposed against target material 106. Press plate 110 may be a plate-like structure or a plurality of interconnected beams as shown in the drawings. In order to increase the degree of compression on the rear portion of target material 106, spacers 112 are placed between the top of target material 106 and the rear 114 and center 116 legs of press plate 110. No spacer 112 is located between the front leg 118 of press plate 110 and target material 106. This configuration compresses the rear portion of target material 106 more than the front portion of target material 106 such that fast arrows will pass through the front portion and be stopped by the rear portion while slow arrows will enter the front portion and be stopped.

Figure 2:
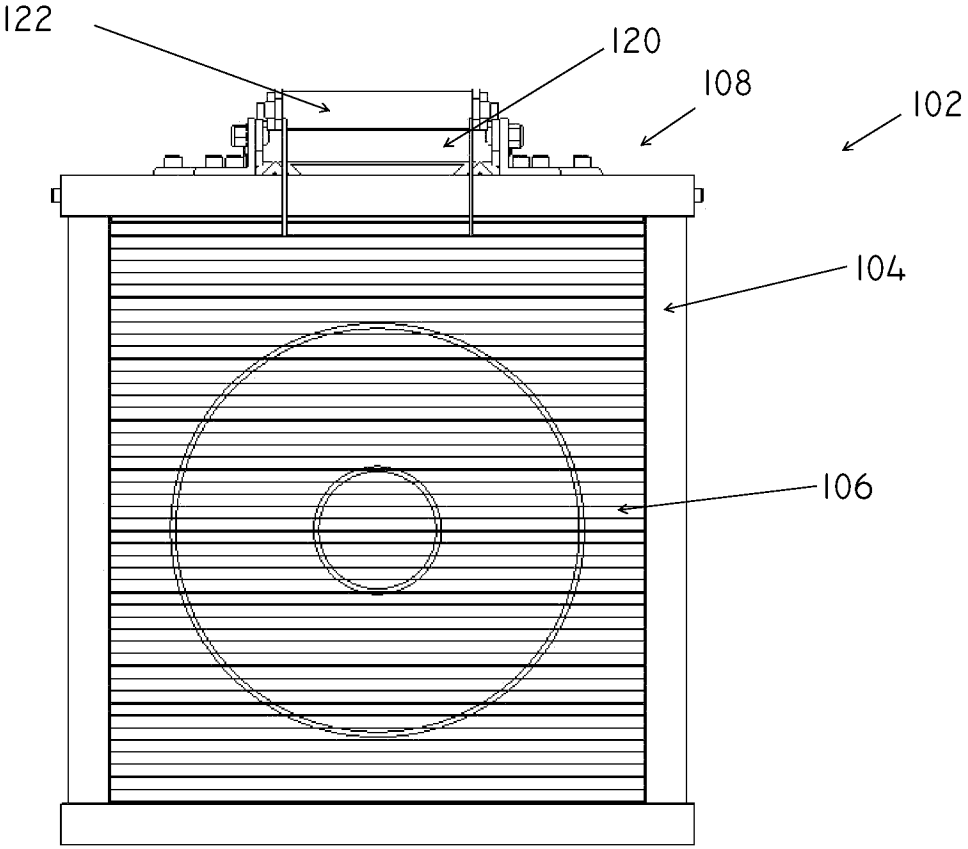
FIG. 2 is a front view of FIG. 1.
Figure 3:
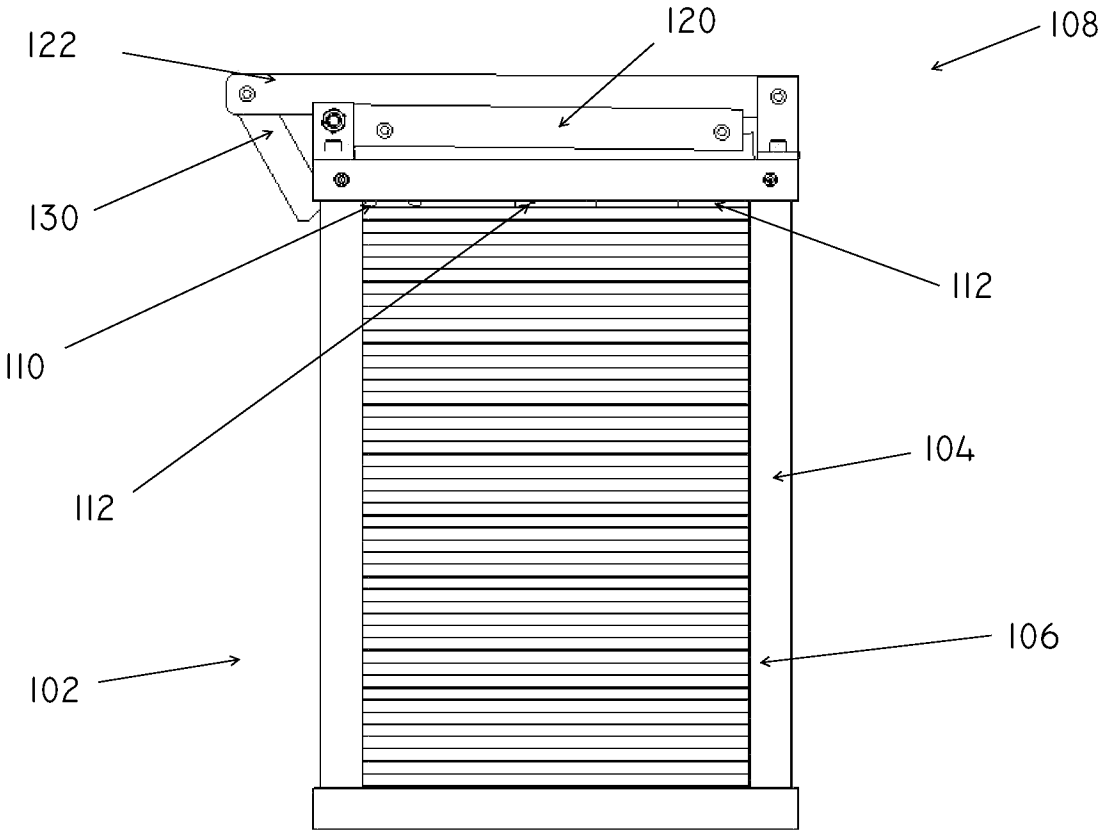
FIG. 3 is a side view of FIG. 1.
Figure 4:
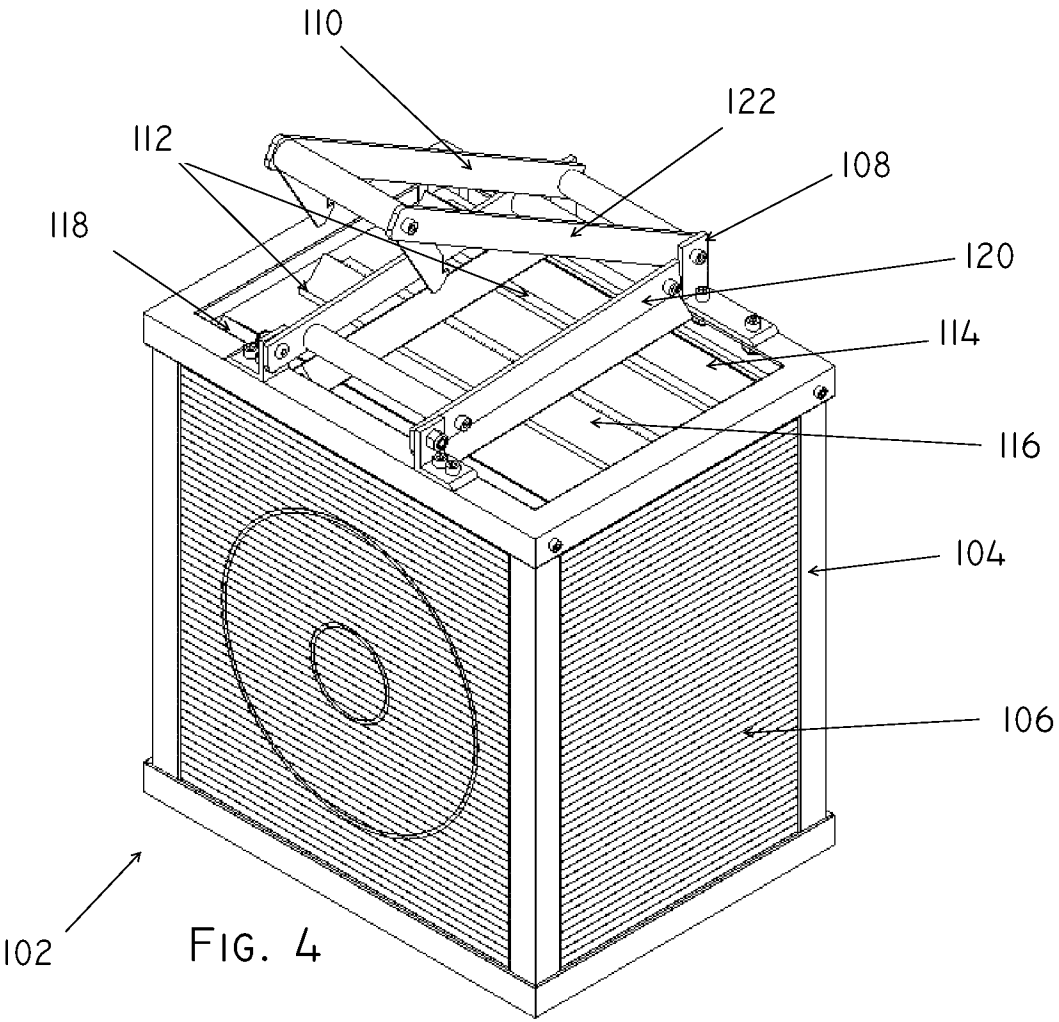
FIGS. 4-7 are perspective views showing the clamping assembly changing from the first configuration to the second configuration.
Figure 5:
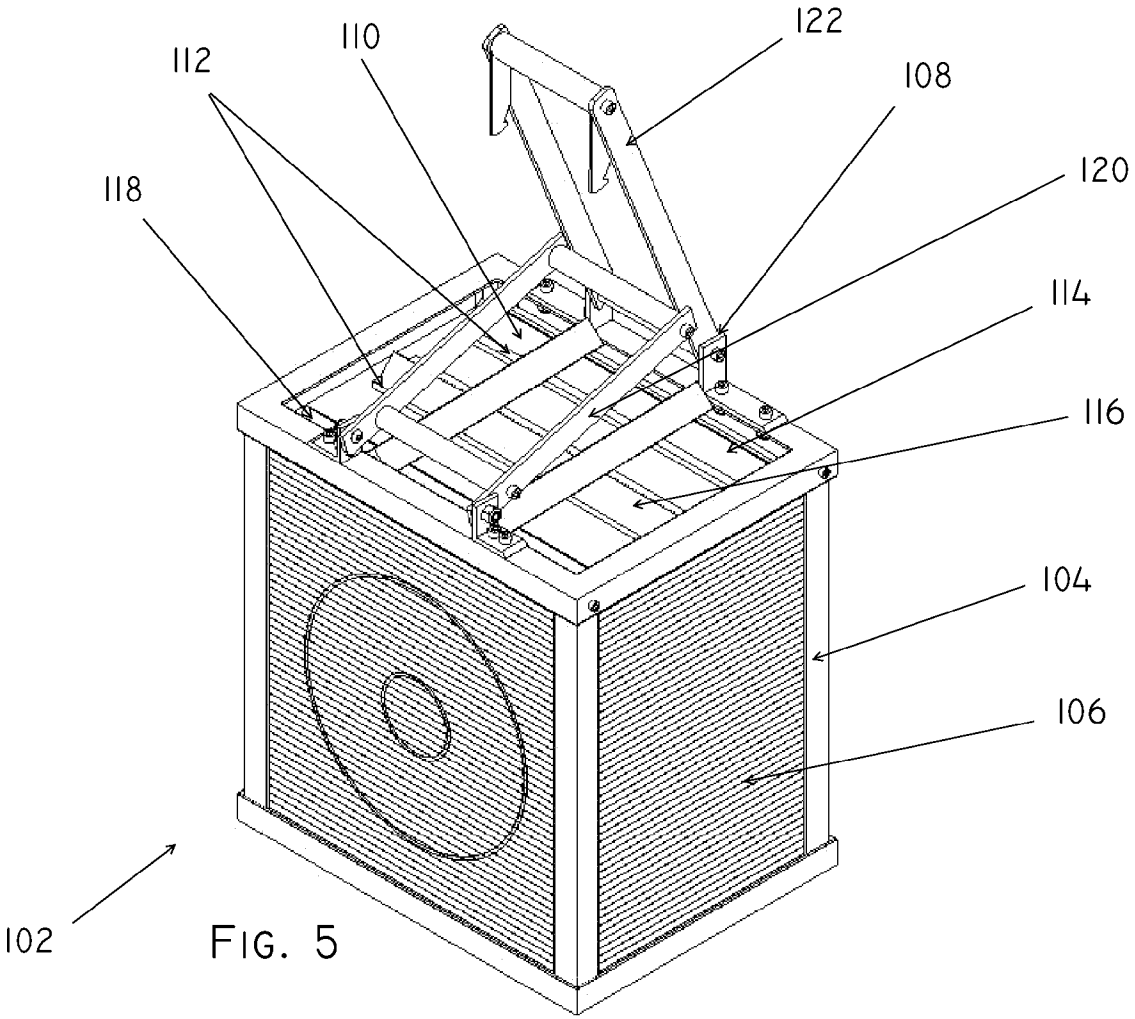
Figure 6:
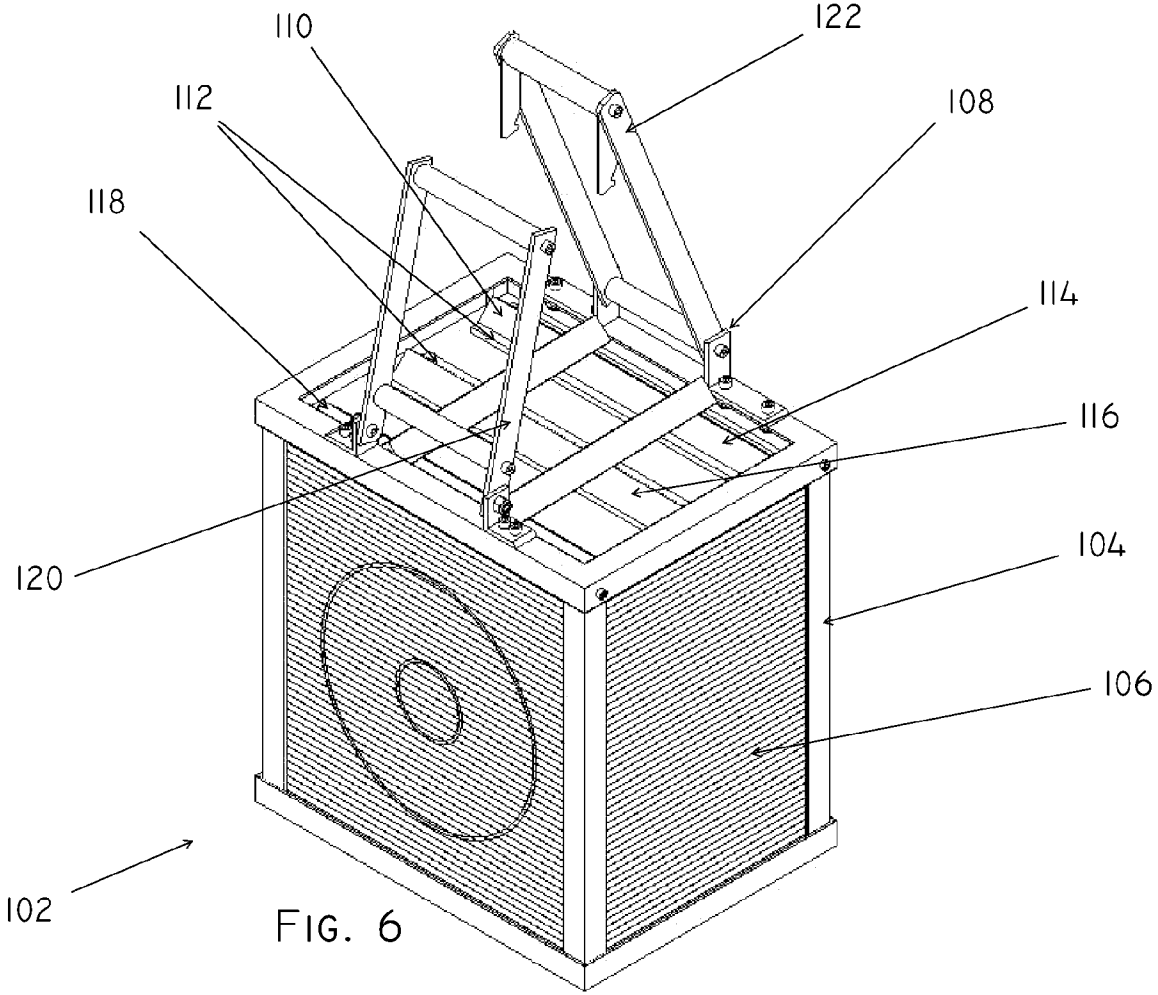
Figure 7:
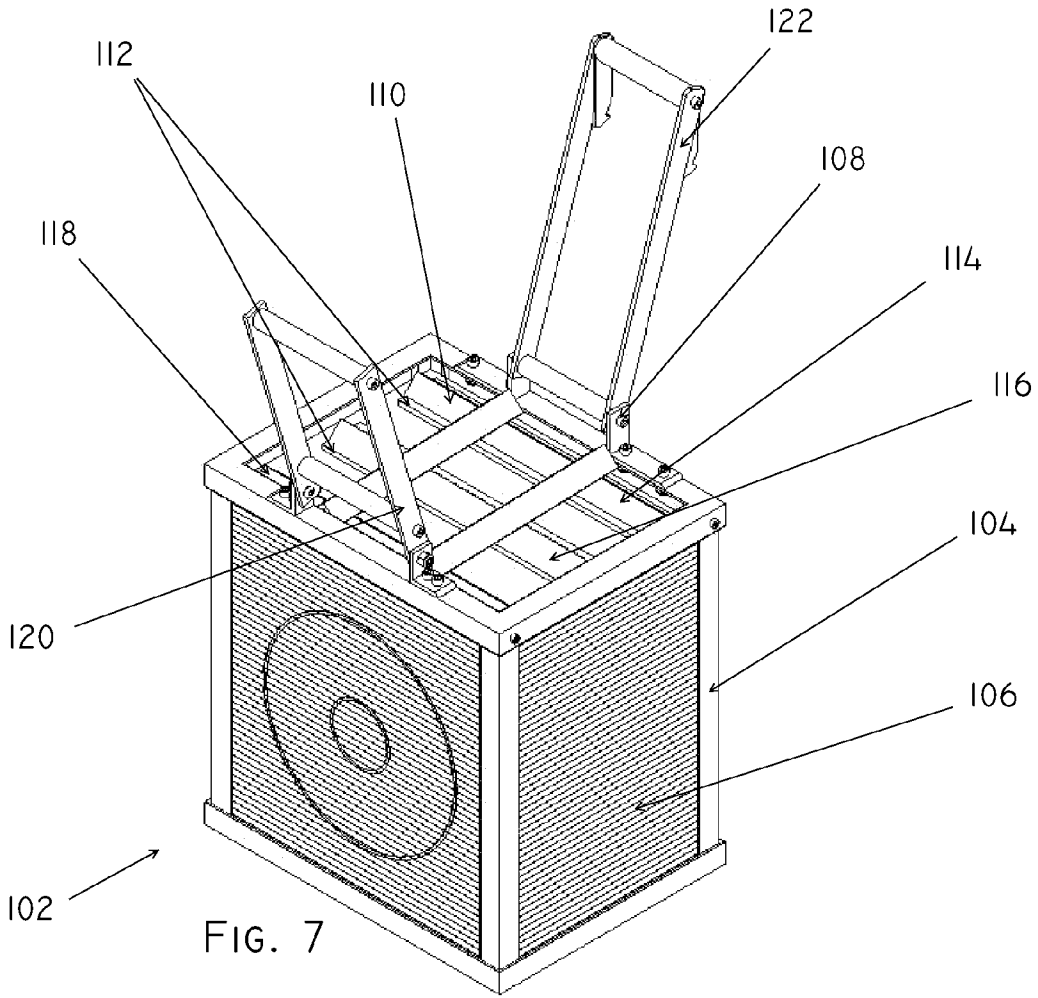
Figure 8:
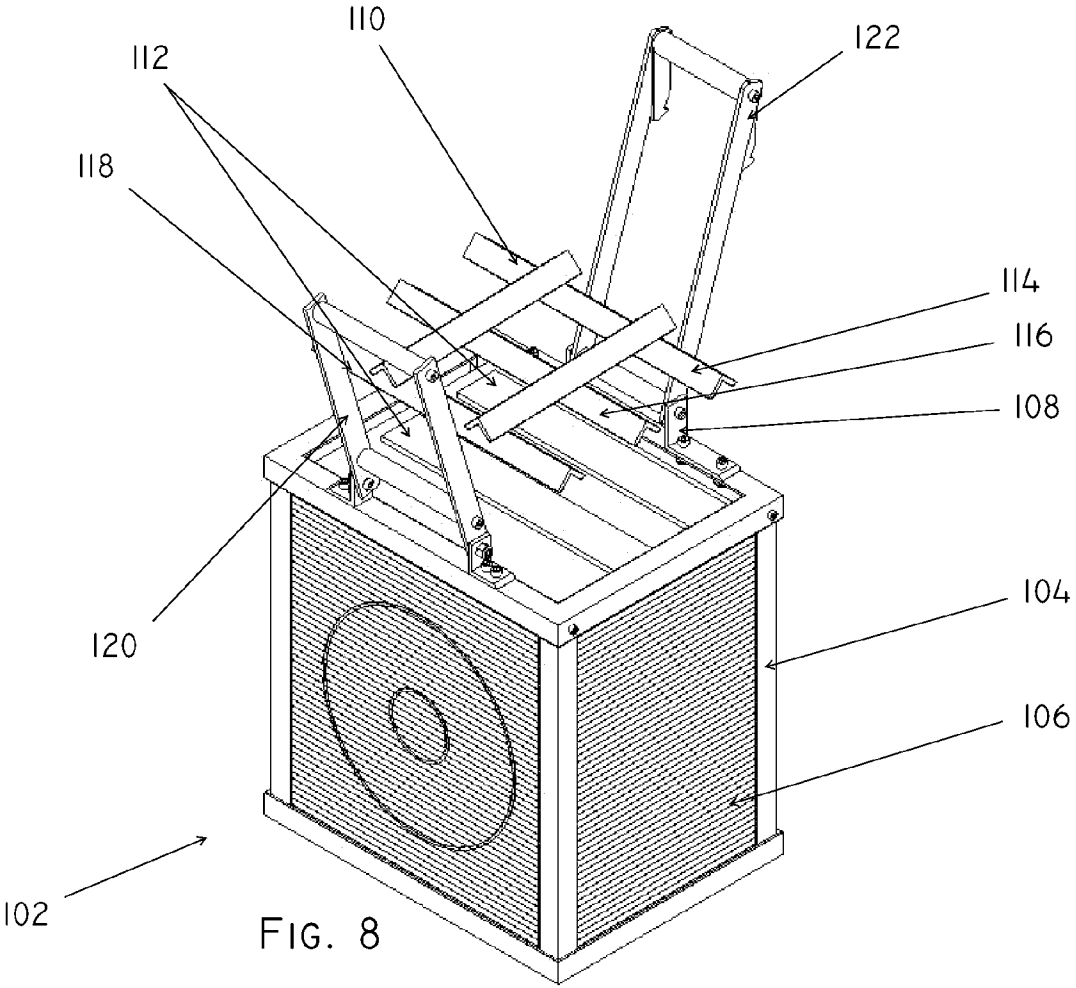
FIG. 8 is a perspective view showing the press plate removed from the target material.
Figure 9:
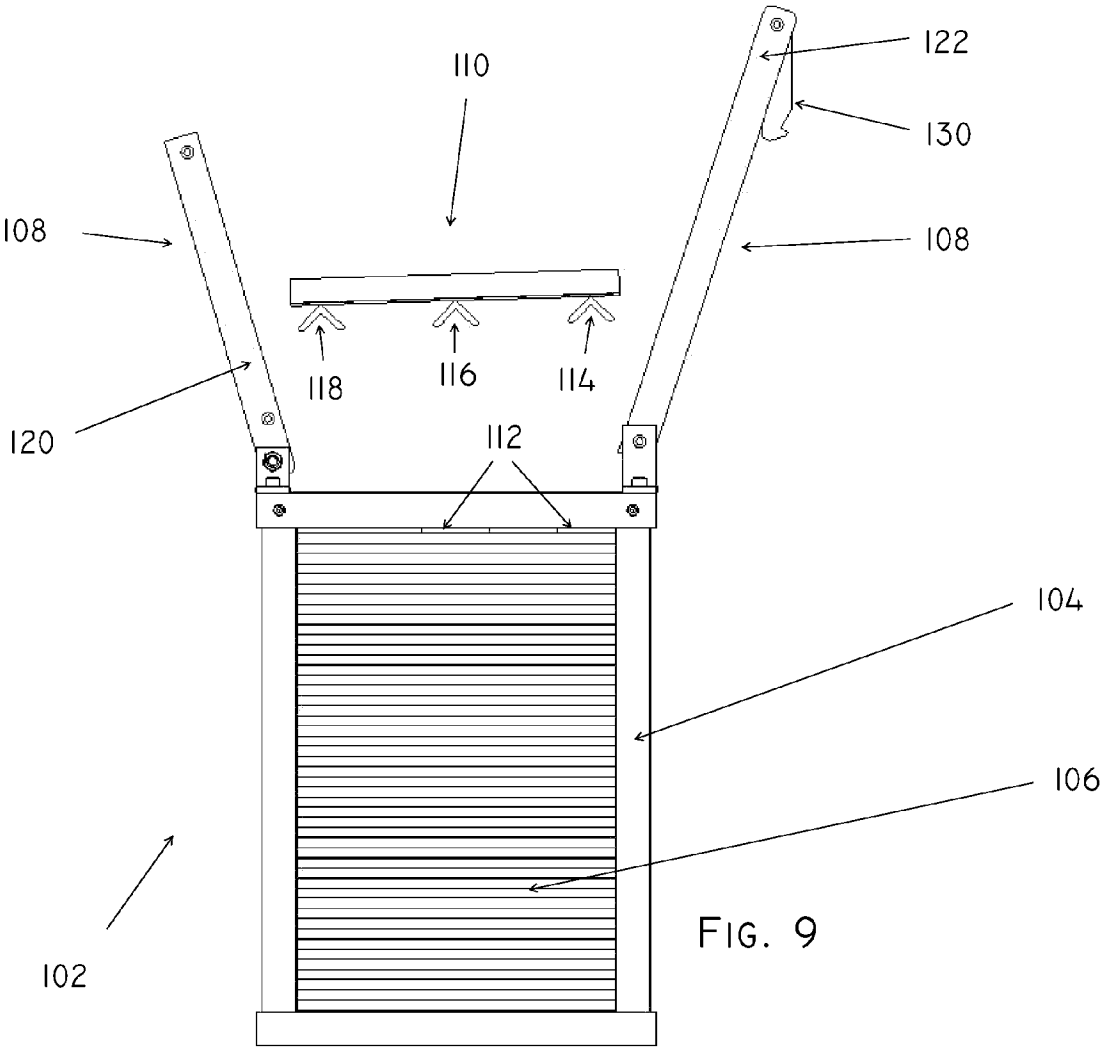
FIG. 9 is a side view of FIG. 8.
Figure 10:
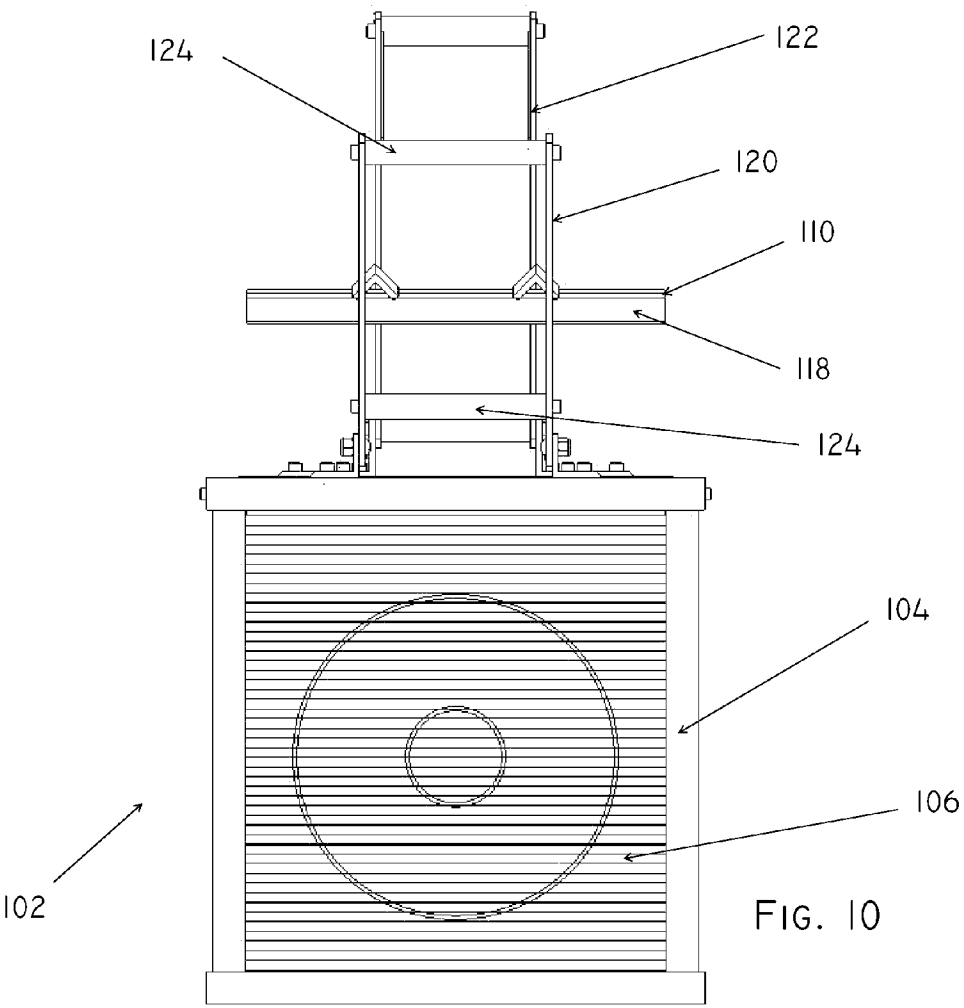
FIG. 10 is a front view of FIG. 8.
Figure 11:
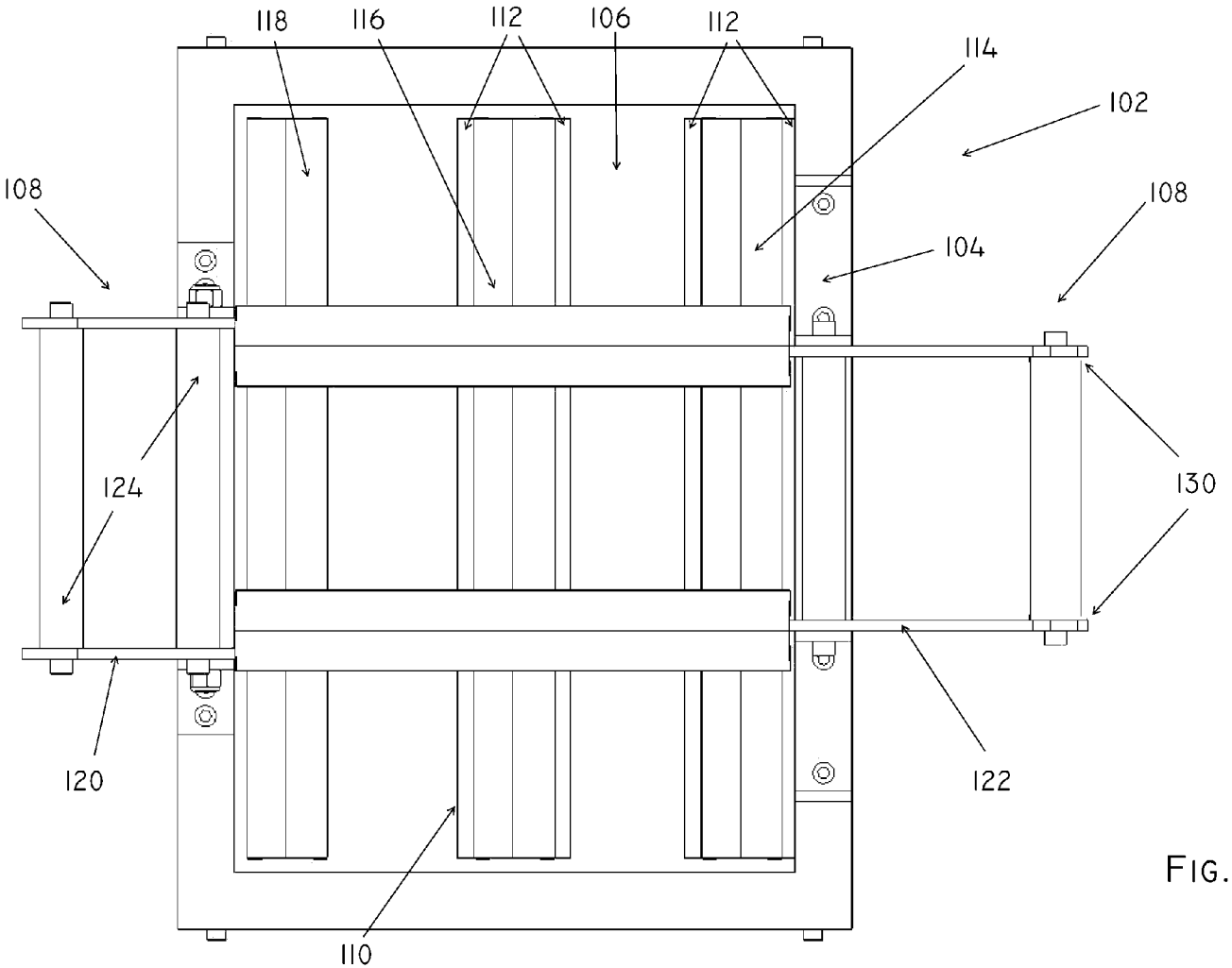
FIG. 11 is a top view of FIG. 8.

Clamping assembly 108 has at least first and second conditions. In the exemplary configuration of target 102 depicted in the drawings, the first compressed condition of clamping assembly 108 is depicted in FIGS. 1-3. Target 102 may be used to stop arrows when target 102 is in this condition. FIGS. 4-7 show how the exemplary clamping assembly 108 releases the compressing force from target material 106. FIG. 8 shows how the press plate 110 may be removed to allow target material 106 to be removed from frame 104.

Clamping assembly 108 includes first 120 and second 122 lever arms that cooperate to apply compressing force to target material 106. First lever arm 120 is hinged to frame 104 opposite to the location where second lever arm 122 is hinged to frame 104. First lever arm 120 rests against the top of press plate 110 and second lever arm folds over the top of first lever arm 120 to engage at least one cross member 124 to even distribute the compressing force to press plate 110. The configuration and position of cross member(s) 124 can vary the amount of compressing force that is provided by clamping assembly 108. Second lever arm 122 includes a latch 130 that engages frame 104 to maintain clamping assembly 108 in the first condition applying compressing force to target material 106. Latch 130 may have a plurality of different teeth so that it engages frame 104 at different positions. Latch may be biased or spring loaded with a button that must be engaged before unlatching.

Other configurations of target 102 include clamping assemblies having piston-cylinders (pneumatic or hydraulic) that drive press plate 110 against target material 106 to apply the compressing force. Further configurations use cam locks, bail levers, rocker bars, ratchet mechanisms with a ratchet release, threaded rods, and springs. Each of these may be used with a hand-release latch or a foot-release latch. Each may be configured to work with a foot pedal that is used to apply the compressing force to the target after the arrows are removed. For example, a foot pedal may be used to activate a ratchet assembly that applies the compressing force.

Target 102 allows different layers of target material to be removed and replaced by opening clamping assembly 108, removing press plate 110 (and any spacers 112), and removing the layers of target material 106. The new layers are inserted, press plate 110 is replaced, and clamping assembly 108 is closed. This allows the overall life of target 102 to be extended if only a few layers of material 106 are worn near the center of the bullseye.

The layers of target material may be inserted horizontally (as shown) or vertically. When they are inserted vertically, the clamping assembly is located on the side of frame 104.

A second configuration of the target is indicated by the numeral 202 and is depicted in FIGS. 12-18. Target 202 generally includes a frame 204, a target material 206, and a clamping assembly 208. Clamping assembly 208 may be actuated between first and second conditions with respect to target material 206. The first condition applies compressing force to target material 206 so that target 102 may be used to stop arrows from a bow or crossbow. As described in the Background Information, there are problems with removing arrows from compressed target material. As such, the second condition of clamping assembly 208 releases all or at least a portion of the compressing force from target material 206 so that the arrows may be readily removed from target material 206.

Figure 16:
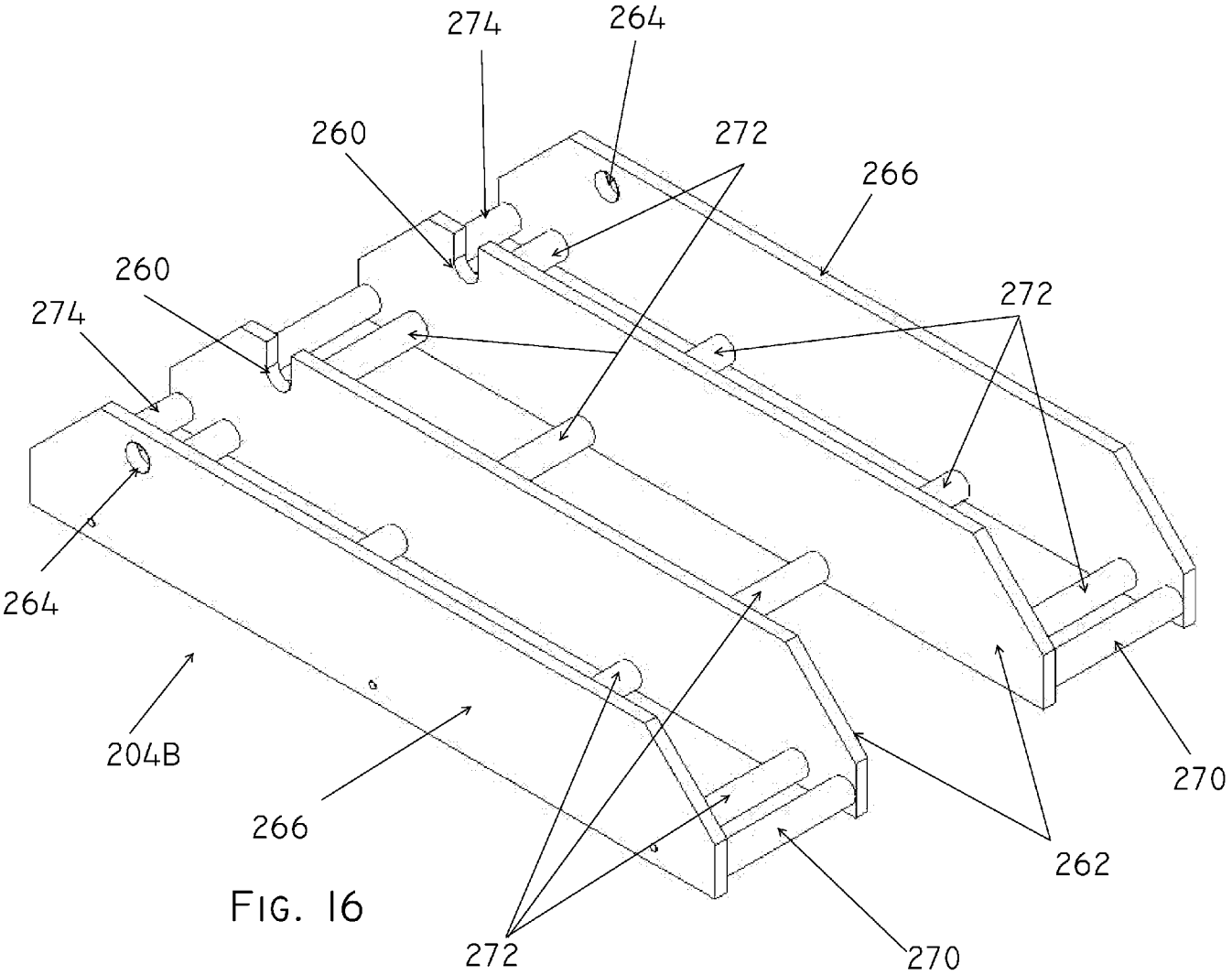
FIG. 16 is a perspective view of the clamp structure of the frame.

Frame 204 may be a rigid box-shaped frame similar to frame 104 described above or may be provided in the form of the separated base plate 204A (FIG. 13) and crank frame 204B (FIG. 16). The base plate portion of frame 204 is disposed on one side target material 206 while crank frame 204B is disposed on the opposite side. In the exemplary configuration of the second configuration depicted in the drawings, base plate 204A is disposed under target material 206 and crank frame 204B is disposed on top of target material 206. These elements may be disposed other sides of the target block in other configurations of the invention. For example, crank frame 204B may be disposed on a side of target material 206 with base plate 204A disposed on the opposite side. In another configuration, a pair of base plates 204A may be disposed on opposite sides with clamping assembly 208 disposed at the rear of target material 206.

Figure 13:
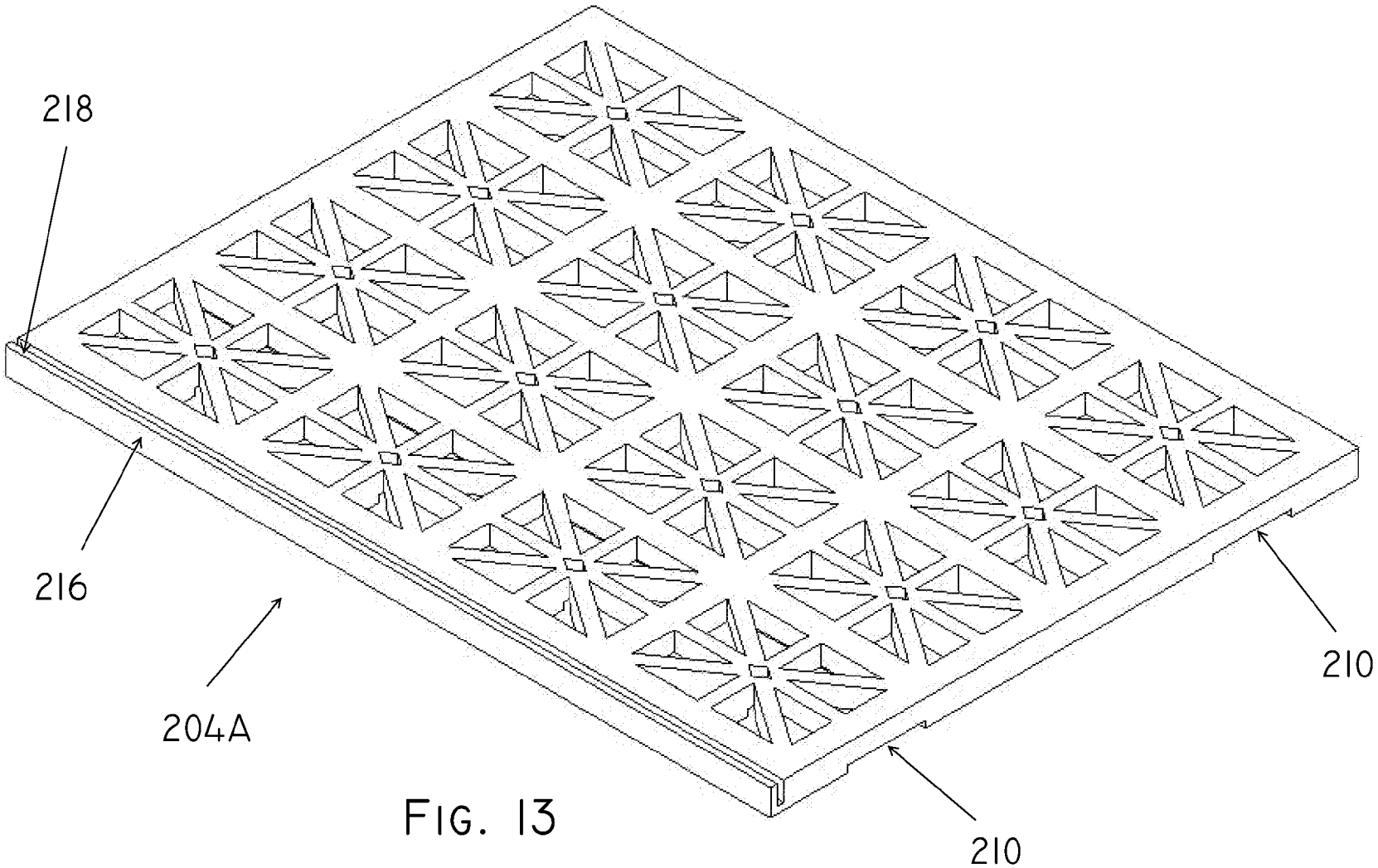
FIG. 13 is a perspective view of the base plate used with the target configuration depicted in FIG. 12.
Figure 14:
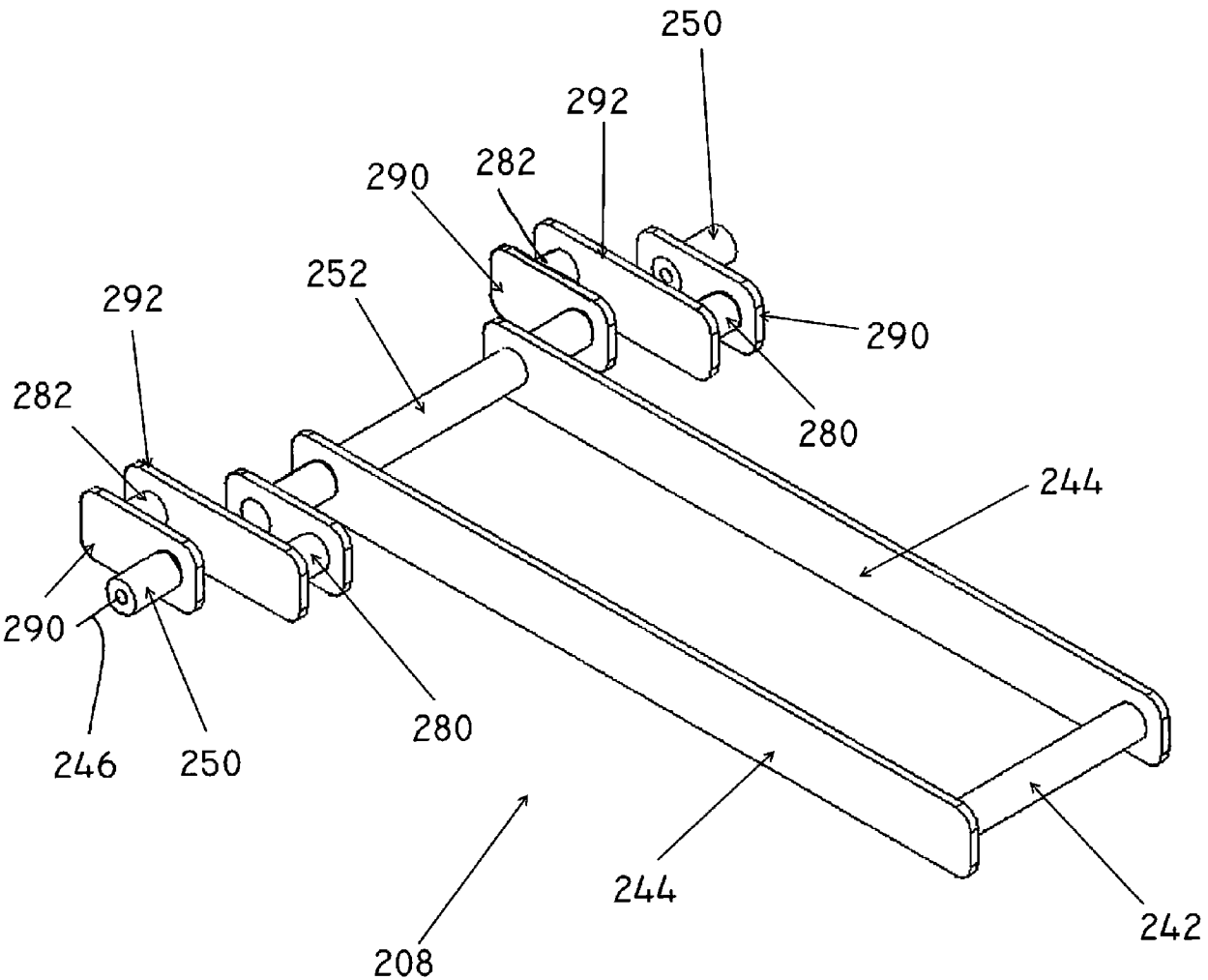
FIG. 14 is a perspective view of the crank.
Figure 15:
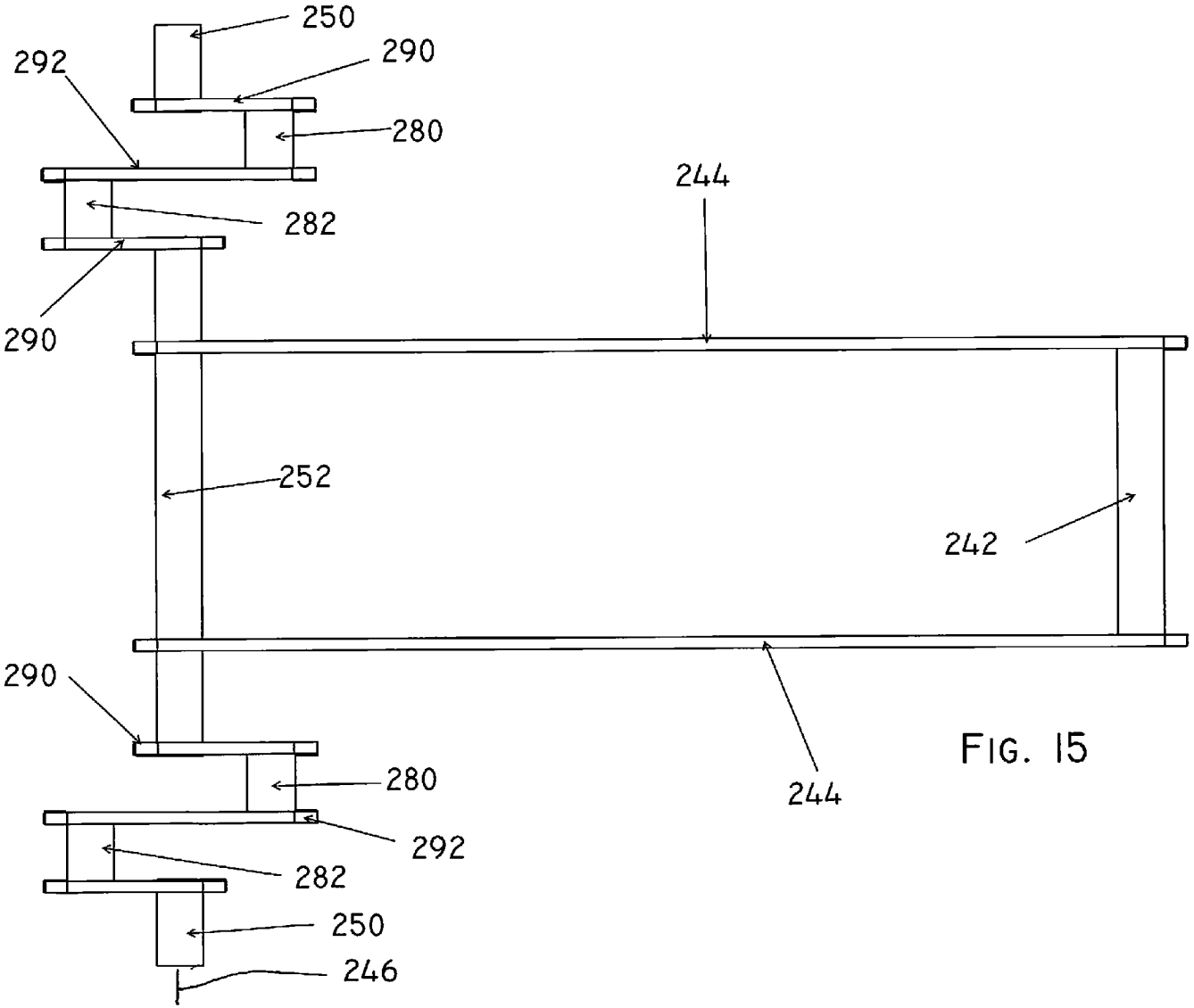
FIG. 15 is a top plan view of the crank.

Base plate 204A is depicted in FIG. 13 and may be fabricated from a rigid building material such as steel, stainless steel, aluminum, plastic, wood, or paper-based materials. In the exemplary configuration, base plate 204A has a body that defines a plurality of openings that reduce the weight of base plate 204A and reduce the amount of material needed to form base plate 204A. The body of base plate 204A also defines at least one strap channel 210 extends from one edge to another edge of the body and open to the bottom surface of the body. The strap channel 210 receives a strap 212 described below. Channel 210 is defined by shoulders that limit the movement of strap 212 with respect to the body of base plate 204A.

Figure 12:
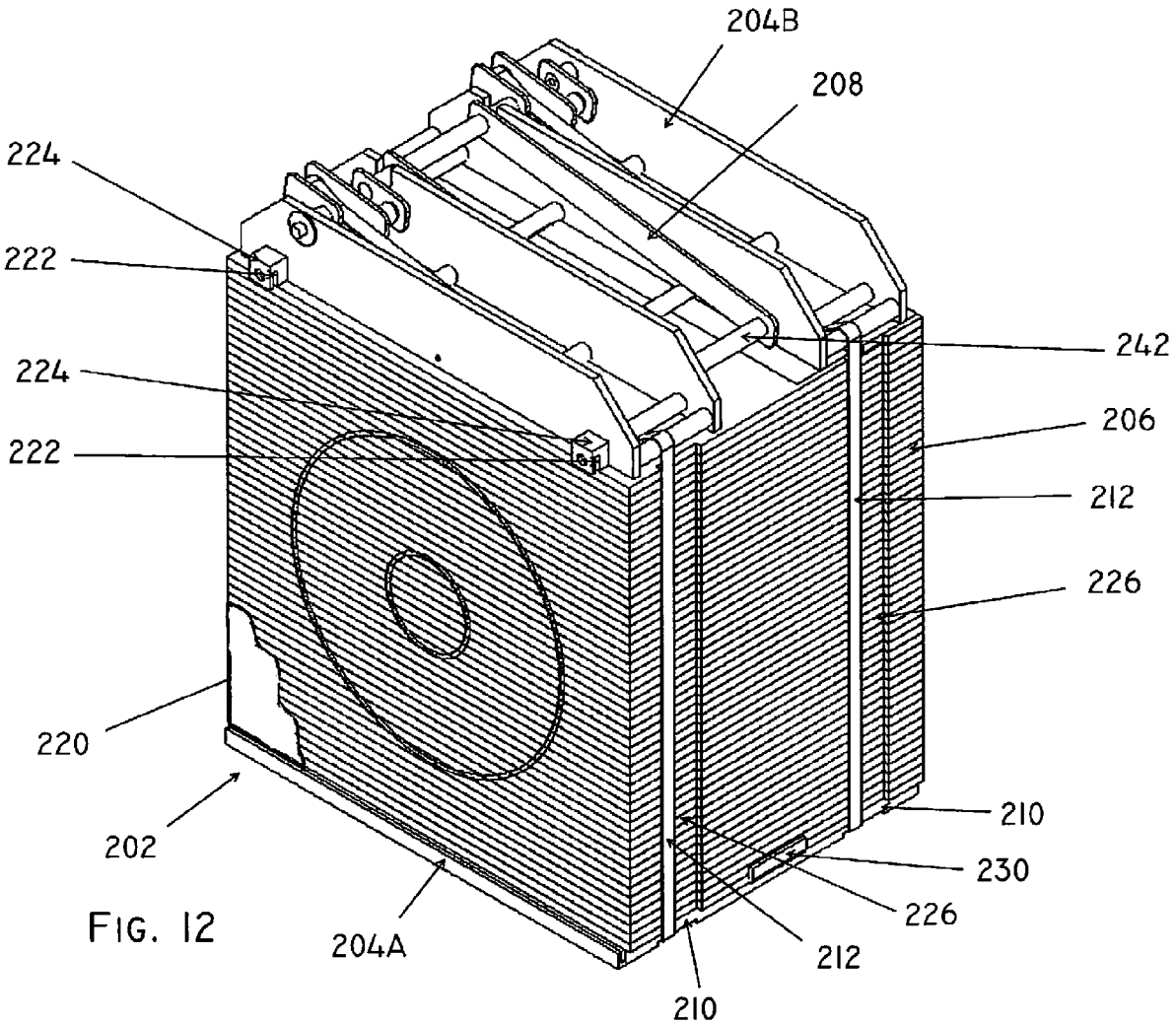
FIG. 12 is a perspective view of a second configuration for the target with its clamping assembly in a first condition applying compressing force to the target material.

Optionally, base plate 204A also defines a shelf 216 that defines a slot 218 that receives the bottom surface of a readily replaceable target cover 220 (a portion of which is depicted in FIG. 12). The top of cover 220 may be receive in an opposing slot 222 defined (in this configuration) by a pair of blocks 224 carried by crank frame 204B. Slots 218 and 222 allow the user to install fresh target covers 220 and readily remove these covers 220 when the user is finished with the target cover 220.

Target material 206 is provided to the second configuration of target 102 in the same options as described above with respect to target material 106. In this configuration, however, it is desirable to form indentations 226 in the portions of target material 206 aligned with channels 210. Indentations 226 function as strap channels that receive straps 212 and also function to prevent target material 206 from moving out of alignment when impacted by arrows. As such, FIG. 12 shows how straps 212 are disposed against the forward shoulder that defines indentations 226. When target material 206 is provided in a plurality of individual stacked layers, each layer of material 206 defines a pair of indentations at opposite edges so that the strap channels are formed when the layers are stacked into a target block.

The second configuration of target 202 allows different portions of target material 206 to be compressed to different degrees. This feature allows the rear portion target material 206 to be more highly compressed than the front portion. In such a configuration, a low speed arrow may be stopped by the front portion while a high speed arrow may be stopped by the rear portion. Such a target configuration is useful when an adult and a child are shooting at a common target with different bows. As described above, the different compression zones may be created by using spacers 112 between clamping assembly 208 and target material 206. The different degrees of compression may be achieved in the second configuration by altering the length of straps 212.

Figure 17:
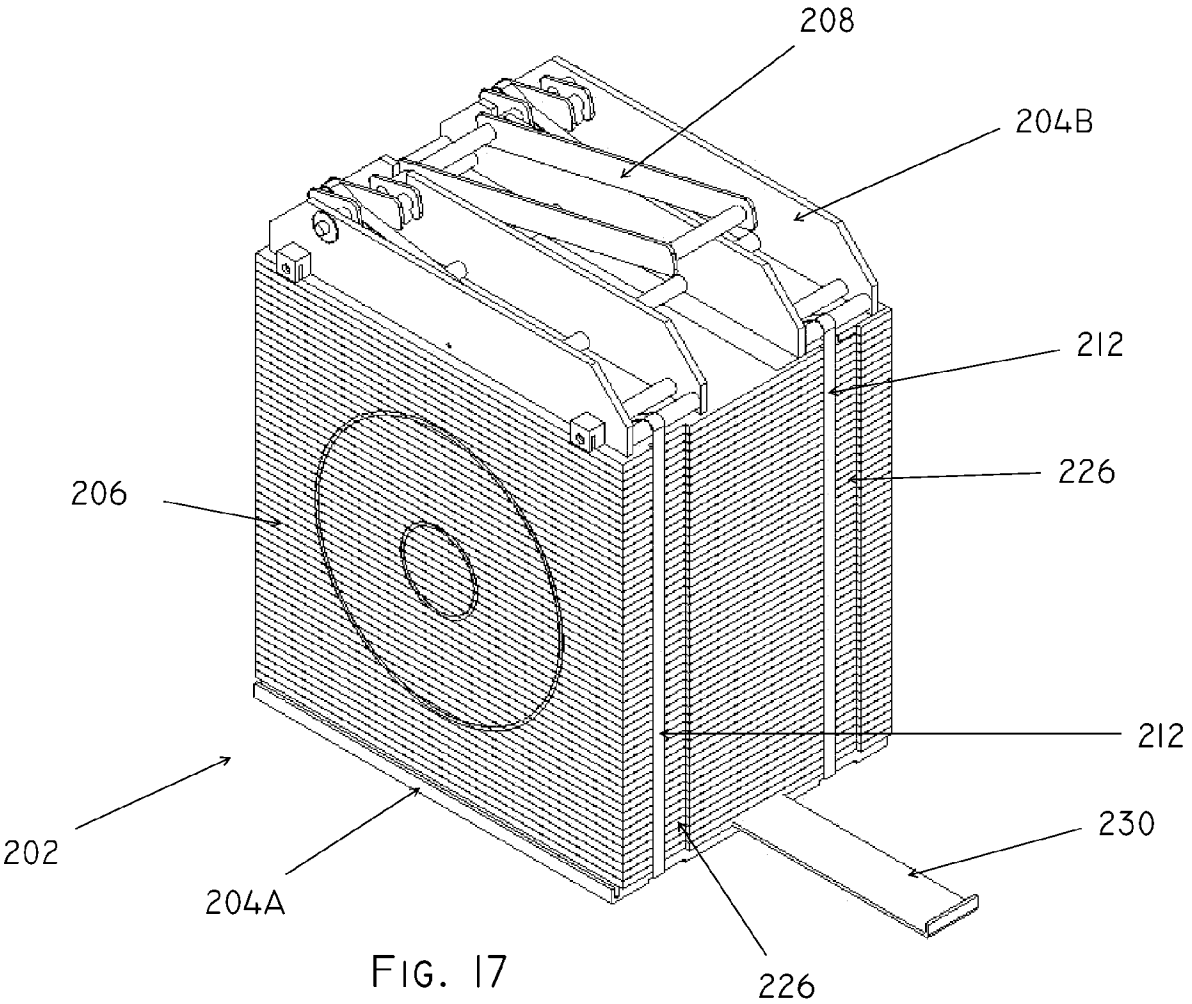
FIGS. 17 and 18 are perspective views showing how the compressing force from the target is released.
Figure 18:
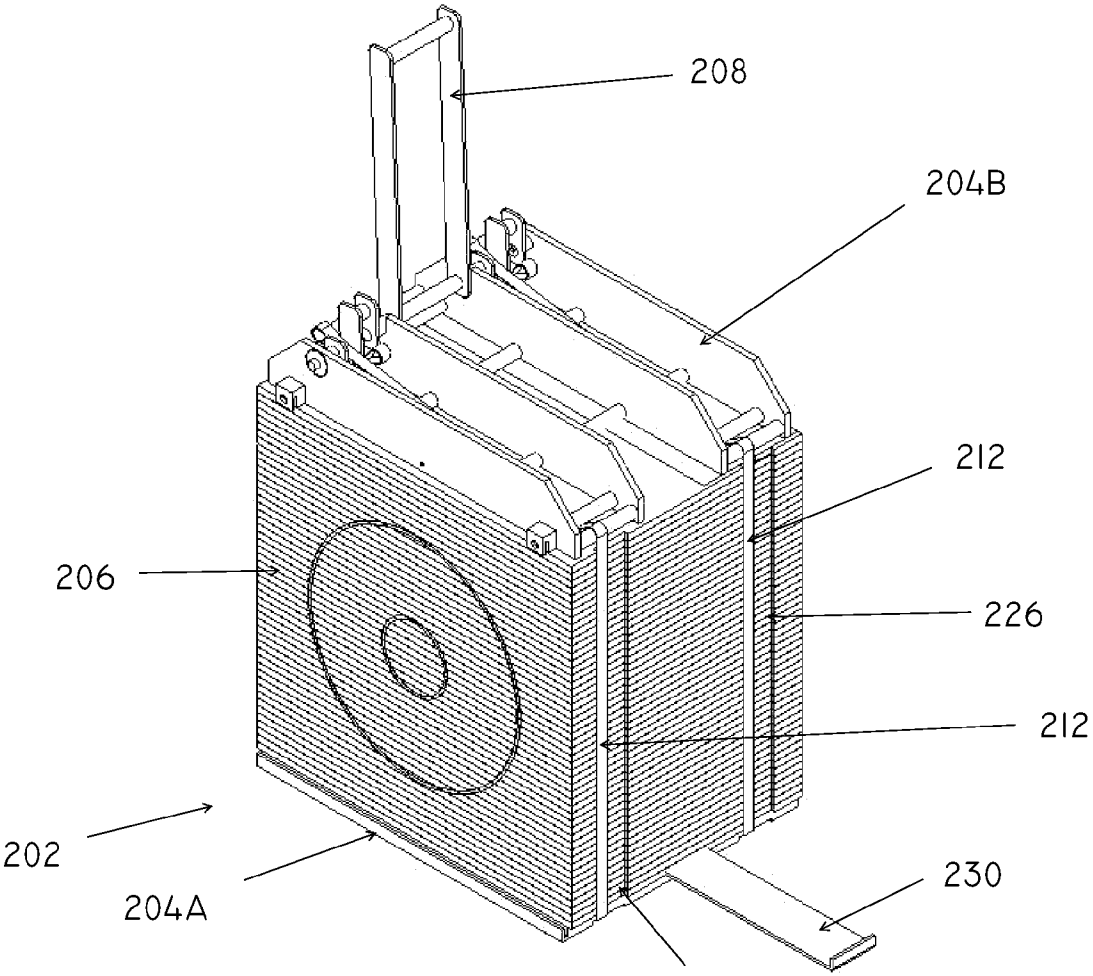

Clamping assembly 208 has at least first and second conditions. The first compressed condition of clamping assembly 208 is depicted in FIG. 12 and the second condition is depicted in FIG. 18. FIG. 17 shows how the exemplary clamping assembly 208 releases the compressing force from target material 206. An extendable foot plate 230 is extended from between base plate 204A and the bottom of target material 206 to provide the user a way to stabilize target 202 while manipulating clamping assembly 208.

Clamping assembly 208 includes a crank 240 that pivots with respect to frame 204B to shorten and lengthen straps 212 to change the compressing force applied to target material 206. Crank 240 is supported from crank frame 2048. Crank 240 includes a handle 242 disposed between and carried by two elongated handle supports 244 that extend from the pivot axis 246 of crank 240 to provide leverage to the user. Handle 242 may rotate freely with respect to handle supports 244.

Figure 19:
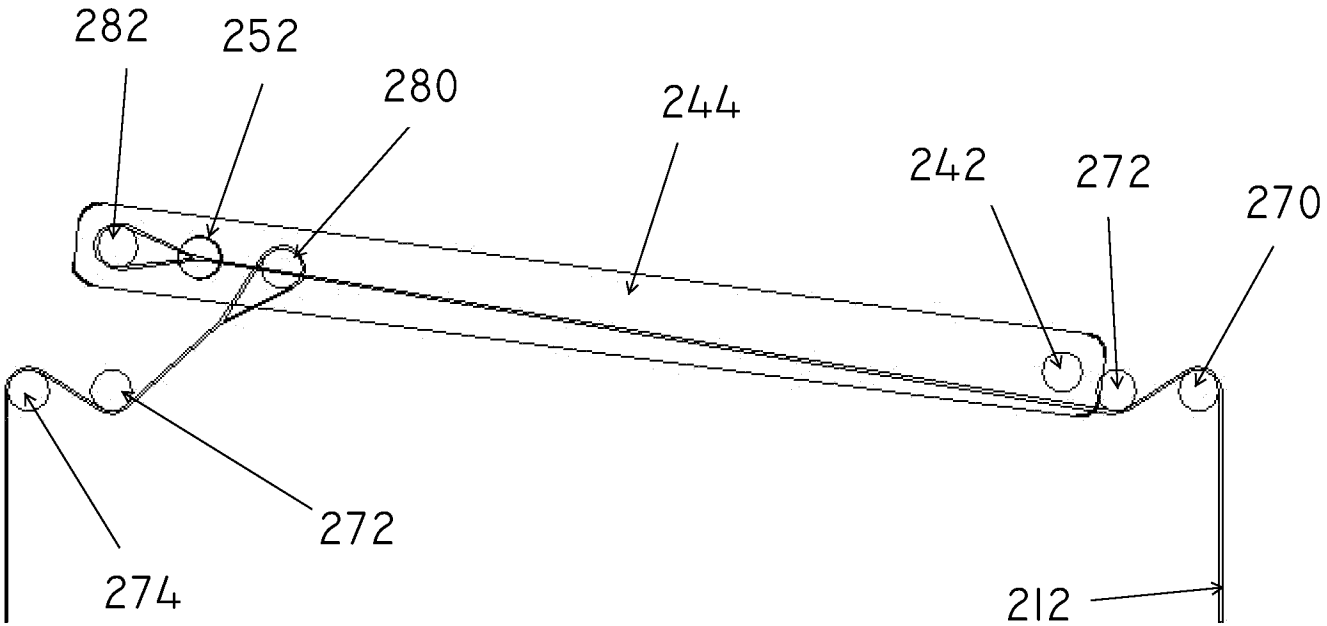
FIGS. 19 and 20 are schematic side views of the crank in the first and second conditions.

A pair of outer pivot pins 250 and an intermediate pivot pin 252 are disposed along pivot axis 246 and are used to support crank 240 from frame 204B. Handle supports 244 are supported from intermediate pivot pin 252 and are connected to intermediate pivot pin 252 such that intermediate pivot pin 252 rotates with handle supports 244. Intermediate pivot pin 252 is received in a pair of slots 260 defined at the tops of the two intermediate walls 262 of frame 204B. Outer pivot pins 250 are received in openings 264 defined by the outer walls 266 of frame 204B. The location of pivot axis 246 is disposed close to the top of walls 262 and 266 allows handle 242 to be pivoted down to the first condition wherein handle 242 is disposed below (closer to target material 206) pivot axis 246 as shown in FIGS. 12 and 19.

Figure 20:
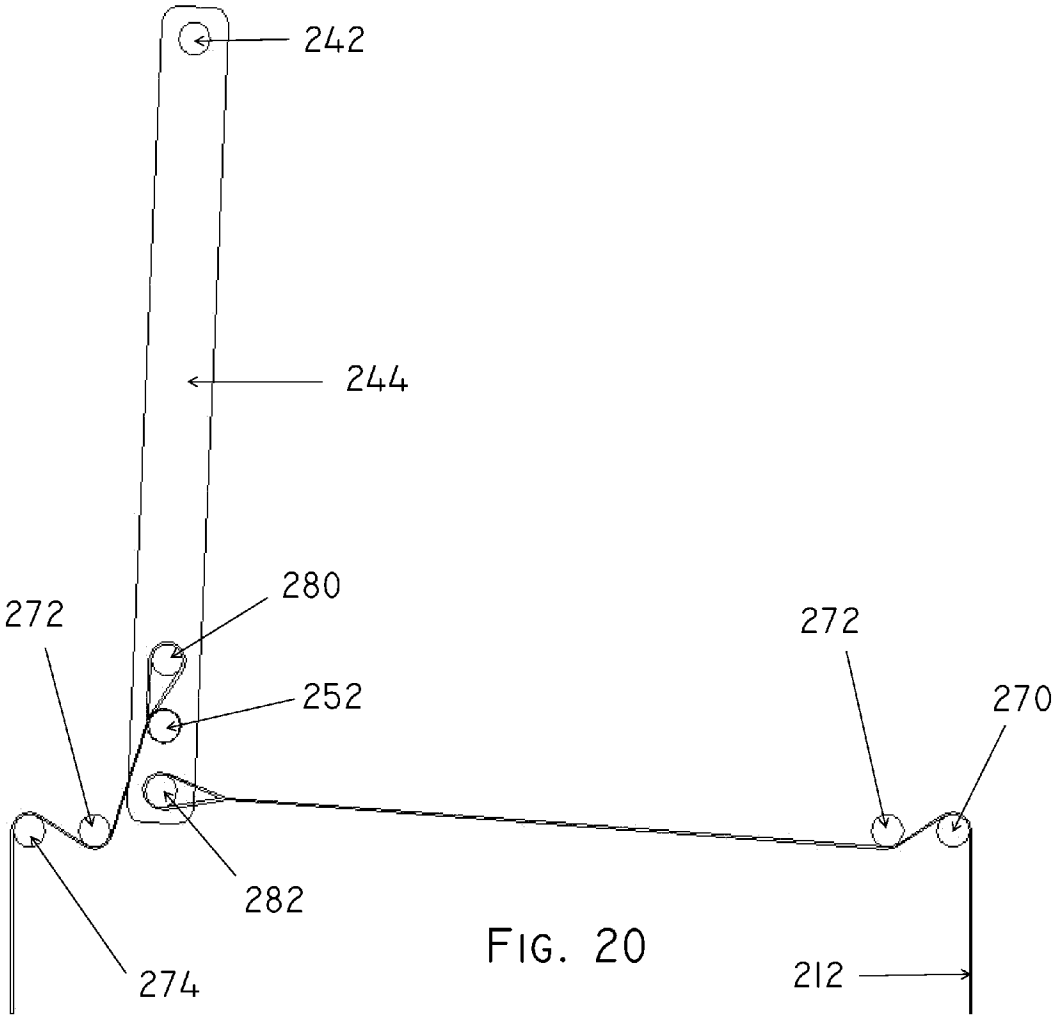

Walls 262 and 266 rest on top of target material 206 and transfer the force from straps 212 down onto material 206. As described above, spacers 112 may be used under frame 204B. Cross bars 270, 272, and 274 hold walls 262 and 266 together. These bars may be fixed or rotate. The portions of front 270 and rear 274 cross bars disposed between outer 266 and intermediate 262 walls function as strap supports over which straps 212 are disposed and slide when crank 240 is moved. There are three intermediate cross bars 272 that extend entirely across all four walls 262 and 266 with the fourth intermediate cross bar 272 disposed behind front cross bar 270 not extending between intermediate walls 262 in order to leave space from handle 242 when handle 242 is in the first position. FIGS. 19 and 20 depict how straps 212 are disposed with respect to cross bars 270, 272, and 274 when crank 240 is in the first and second conditions.

Crank 240 includes two sets of first 280 and second 282 strap anchors that are offset from pins 250 and 252 in opposite directions. The ends of straps 212 are secured to or around these anchors 280 and 282 so that straps 212 are tightened about target material 206 when crank 240 is moved from the second condition of FIGS. 18 and 20 to the first condition of FIGS. 19 and 12. Outer crank arms 290 and a common crank arm 292 support anchors 280 and 282 in the offset positions with common crank arm 292 extending directly between anchors 280 and 282. In other configurations of the target, one end of strap 212 may be fixed in place and anchored to another element of the target such as bars 272 or 274 or pin 252.

Strap anchors 280 and 282 are disposed in the same plane as handle supports 244 such that first strap anchor 280 is disposed below pivot axis 246 and second strap anchor 282 is disposed above pivot axis 246 when handle 242 is in the first or clamped condition. In these positions, straps 212 are disposed in tension such that straps 212 are pulling forward (toward handle 242) on second anchor 282 and are pulling rearwardly (away from handle 242) on first anchor 280. Anchors 280 and 282 are positioned such that the tension in straps 212 are forcing handle 242 toward the first or clamped condition. In order to move crank 240 to the second or released condition, cranks 280 and 282 initially further tighten straps 212 before beginning to release the tension in straps 212. This configuration allows crank 240 to be self-locking and only a simple safety latch may be used to ensure that crank 240 does not undesirably snap out of the first clamped condition. This safety latch may be disposed between crank 240 and walls 262.

Other configurations of target 202 include clamping assemblies having piston-cylinders (pneumatic or hydraulic) that tighten straps 212 against target material 206 to apply the compressing force. Further configurations use powered or manual winders to tighten straps 212. Ratcheted mechanisms also may be used. Each of these may be used with a hand-release latch or a foot-release latch. Each may be configured to work with a foot pedal that is used to apply the compression to the target after the arrows are removed.

Target 202 allows different layers of target material to be removed and replaced by opening clamping assembly 208, removing straps 212, and removing the layers of target material 206. The new layers are inserted, straps 212 are replaced, and clamping assembly 208 is replaced and closed. This allows the overall life of target 202 to be extended if only a few layers of material 106 are worn near the center of the bullseye.

Figure 21:
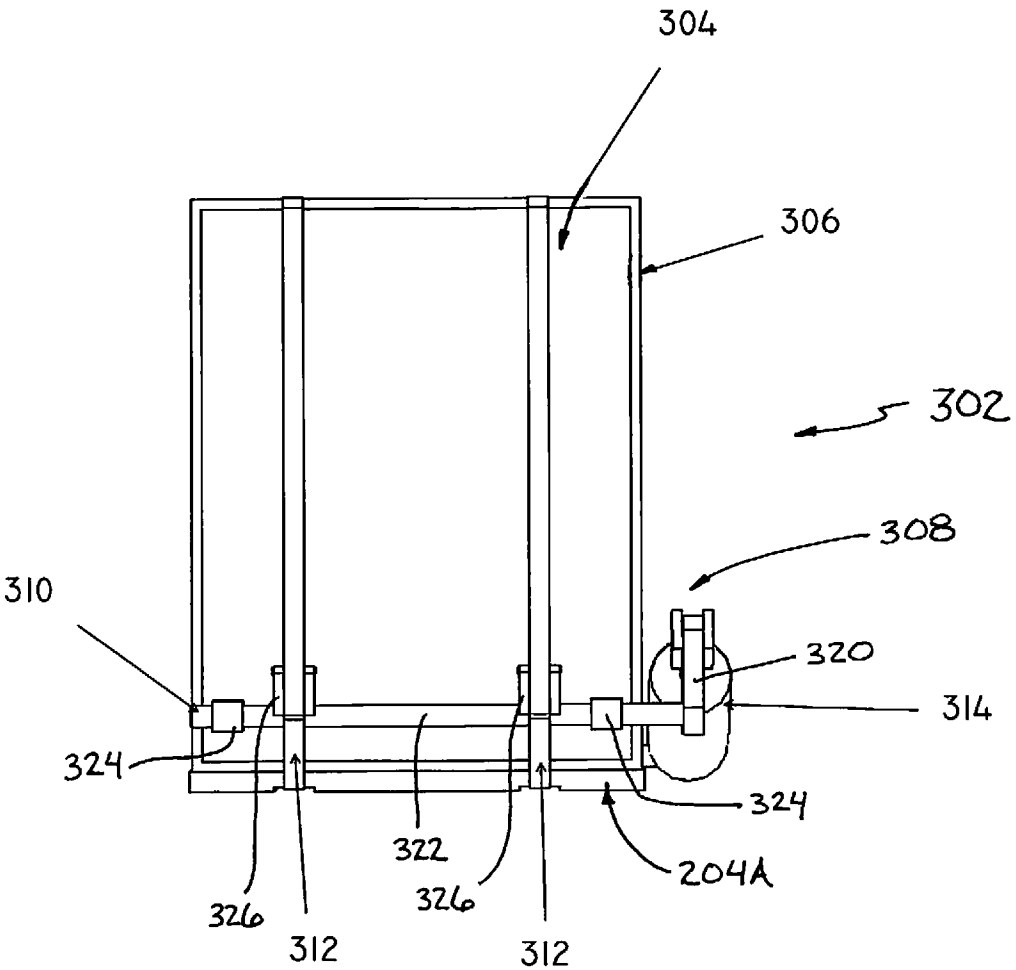
FIG. 21 is a side view of a third target configuration.
Figure 22:
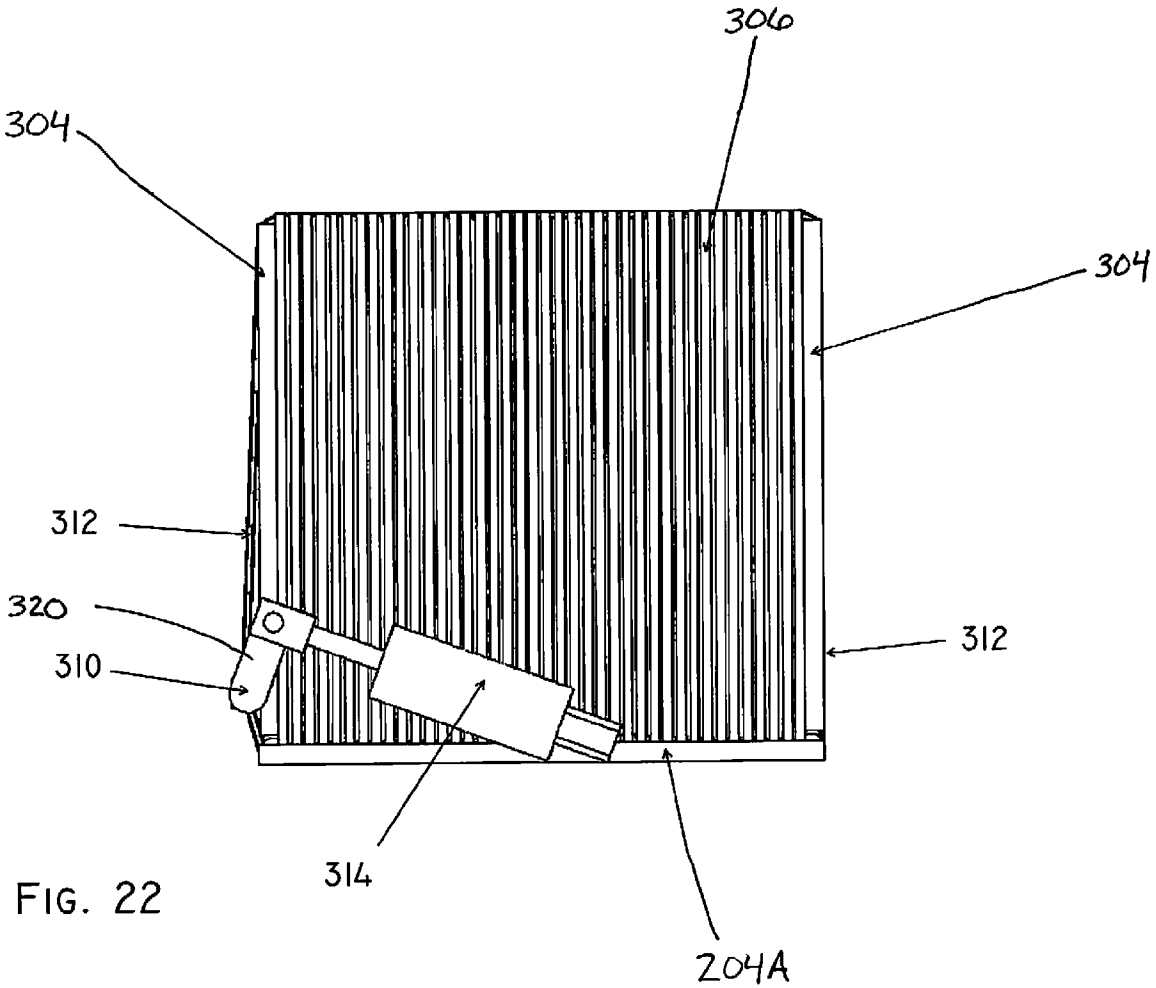
FIG. 22 is a rear view of the third target configuration.
Figure 23:
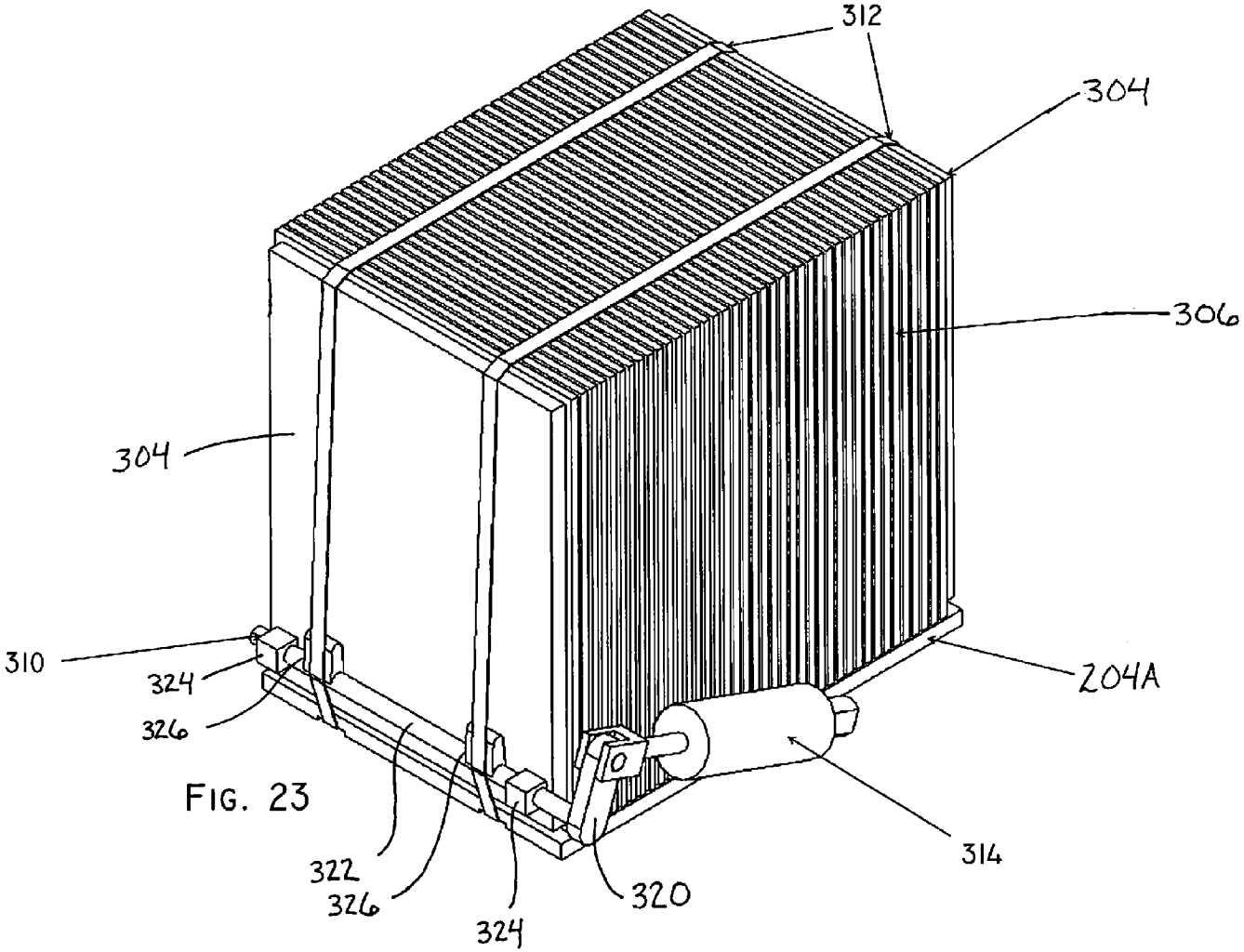
FIG. 23 is a rear perspective view of the third target configuration.

FIGS. 21-23 depict a third target configuration indicated generally by the numeral 302. In this configuration, target material 306 is compressed with a clamping assembly 308 that includes a crank 310, at least one strap 312, and an actuator that is depicted in the form of a cylinder 314. Target material 306 is the same as described above with respect to target material 106. Clamping assembly 308 is actuated between first and second conditions to compress and release the compression force from target material 306. Cylinder 314 may be pneumatic or hydraulic. Cylinder 314 also may be a threaded power screw.

In this configuration, target material 306 is provided in a plurality of vertically stacked layers on base 204A (described above) with a pair of floating end plates 304 disposed on opposed sides of target material 306. End plates 304 are said to be "floating" because at least their lateral positions are not fixed with respect to base plate 204A. In the side view shown in FIG. 21, the arrows would be shot from the left hand side of the page toward target 302. End plates 304 help transfer the compressing force from the straps 312 to target material 306. In other configurations, end plates 304 may not be used and straps 312 may be positioned directly around target material 306 or may include small strap holders that help maintain the position of straps 312 and reduce damage to the outer surfaces of target material 306.

Straps 312 extend around target material 306, base plate 204A, and both end plates 304. The length of each strap 312 is fixed when straps 312 are in use. Base plate 204A includes the strap channels described above and end plates 304 also may include similar channels for straps 312. The upper corner of end plates 304 may be rounded or may carry a roller that supports straps 312 in order to reduce wear to straps 312.

Crank 310 includes a lever 320 that is connected with the extendable arm of cylinder 314. Lever 320 is connected to a bar 322 that is rotatably carried by a pair of support blocks 324 that are carried by or disposed against one of end plates 304. One crank arm 326 extends from bar 322 at the position of each strap 312 used with target 302. Each crank arm 326 is disposed under a strap 312 such that rotation of bar 322 by lever 320 causes straps 312 to be push out away from end plate 304 to tighten straps 312 around target material 306 to compress target material 306. The ends of crank arms 326 are smoothly rounded to reduce wear on straps 312.

Cylinder 314 is mounted to base plate 204A and may be controlled with a hand switch or a foot pedal. Crank 310 may be in the form of a powered or manual winder that has a ratchet mechanism.

Figure 24:
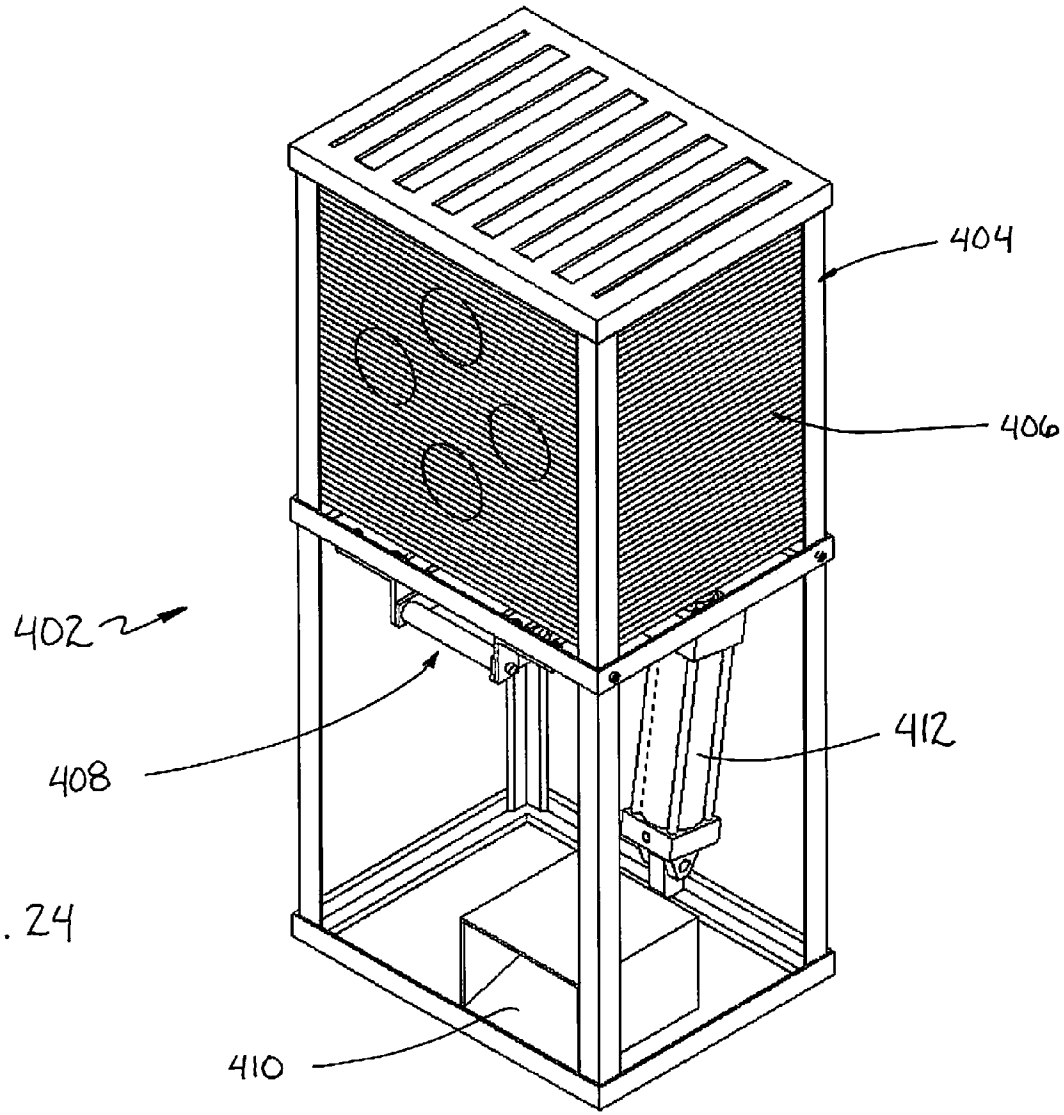
FIG. 24 is a perspective view of a fourth target configuration using a cylinder as part of the clamping assembly.

FIG. 24 depicts a fourth target configuration indicated generally by the numeral 402. In this configuration, target material 406 is disposed in a frame 404 with the clamping assembly 408 disposed below target material 406. A foot pedal 410 is used to actuate clamping assembly 408. Clamping assembly 408 otherwise may have the same elements as clamping assembly 108 described above. A pneumatic or hydraulic cylinder 412 is connected to a supply pump or compressor to supply the compressing force to target 402. In other configurations, a plurality of cylinders 412 push directly up against spacers 112 (described above) or a plate to supply the compressing force to target material 406.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A method for using an archery target comprising the steps of:

compressing a target material to a first condition with a compressing force wherein the target material is adapted to receive arrows; the step of compressing the target material including the step of simultaneously tightening a plurality of straps around the target material;

shooting arrows into the target material;

releasing at least some of the compressing force from the target material before the arrows are removed from the target material; the step of releasing at least some of the compressing force including the step of simultaneously loosening the plurality of straps; and removing the arrows from the target material after at least some of the compressing force is released; and further comprising the step of pivoting a lever from a second position to a first position to simultaneously tighten the plurality of straps around the target material.

2. The method of claim 1, further comprising the step of actuating a piston cylinder to simultaneously tighten the plurality of straps around the target material.

3. A method for using an archery target comprising the steps of:

compressing a target material to a first condition with a compressing force wherein the target material is adapted to receive arrows;

shooting arrows into the target material;

releasing at least some of the compressing force from the target material before the arrows are removed from the target material;

removing the arrows from the target material after at least some of the compressing force is released; and further comprising the step applying the compressing force to the target material unevenly to allow the archery target to be used with different speed arrows.

4. The method of claim 3, further comprising the step of compressing a rear portion of the target material more than a front portion of the target material.

5. The method of claim 4, further comprising the step of providing a press plate and applying the compressing force to the press plate and locating a spacer under a only a portion of the press plate such that the target material is unevenly compressed.

6. The method of claim 5, further comprising the step of pivoting a lever from a second position to a first position to create the compressing force that compresses the target material.

7. The method of claim 6, further comprising the step of latching the lever in the first position.

8. The method of claim 3, wherein the step of applying the compressing force to the target material unevenly includes the step of tightening straps around the target to provide the uneven compressing force.

9. A method for using an archery target comprising the steps of:

compressing a target material to a first condition with a compressing force wherein the target material is adapted to receive arrows; wherein the step of compressing the target material includes the step of tightening a strap around the target material;

shooting arrows into the target material;

releasing at least some of the compressing force from the target material before the arrows are removed from the target material;

removing the arrows from the target material after at least some of the compressing force is released; and further comprising the step of locating the strap in an indentation defined by the target material.

10. A method for using an archery target comprising the steps of:

compressing a target material to a first condition with a compressing force wherein the target material is adapted to receive arrows;

shooting arrows into the target material;

releasing at least some of the compressing force from the target material before the arrows are removed from the target material;

removing the arrows from the target material after at least some of the compressing force is released;

reapplying the compressing force to the target material after the arrows are removed from the target material;

extending an extendable foot plate from the target; and further comprising the step of stabilizing the target material by standing on the extendable foot plate while reapplying the compressing force to the target material.

11. A method for using an archery target comprising the steps of:

compressing a target material to a first condition with a compressing force wherein the target material is adapted to receive arrows;

shooting arrows into the target material;

releasing at least some of the compressing force from the target material before the arrows are removed from the target material; and removing the arrows from the target material after at least some of the compressing force is released;

reapplying the compressing force to the target material after the arrows are removed from the target material; and wherein the steps of compressing, releasing, and reapplying are each performed through a single actuator to provide speed and convenience to the user; and wherein the steps of compressing and reapplying include the steps of providing a press plate and applying the compressing force to the press plate; and further comprising the step of locating a spacer under a only a portion of the press plate such that the target material is unevenly compressed.

12. A method for using an archery target comprising the steps of:

compressing a target material to a first condition with a compressing force wherein the target material is adapted to receive arrows;

shooting arrows into the target material;

releasing at least some of the compressing force from the target material before the arrows are removed from the target material; and removing the arrows from the target material after at least some of the compressing force is released;

reapplying the compressing force to the target material after the arrows are removed from the target material; and wherein the steps of compressing, releasing, and reapplying are each performed through a single actuator to provide speed and convenience to the user; the single actuator including first and second levers; and further comprising the step of pivoting the first lever from a second position to a first position to create the compressing force that compresses the target material; and further comprising the step of pivoting the first lever against the second lever to create the compressing force that compresses the target material; the first lever pivoting at a location different from the second lever.

13. The method of claim 12, further comprising the step of providing a press plate and applying the compressing force to the press plate.

14. The method of claim 12, further comprising the step of latching the first lever in the first position.

15. The method of claim 12, further comprising the steps of extending an extendable foot plate from the target; and further comprising the step of stabilizing the target material by standing on the extendable foot plate while reapplying the compressing force to the target material.

16. The method of claim 12, further comprising the step of compressing the target material within a frame.

17. The method of claim 12, further comprising the step of providing a press plate and applying the compressing force to the press plate and locating a spacer under a only a portion of the press plate such that the target material is unevenly compressed.

* * * * *